US008226226B2

(12) United States Patent
Kawakami et al.

(10) Patent No.: US 8,226,226 B2
(45) Date of Patent: Jul. 24, 2012

(54) METHOD FOR INKJET RECORDING

(75) Inventors: Hiroshi Kawakami, Shizuoka-ken (JP); Kazuo Sanada, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 542 days.

(21) Appl. No.: 12/490,324

(22) Filed: Jun. 24, 2009

(65) Prior Publication Data

US 2010/0033527 A1 Feb. 11, 2010

(30) Foreign Application Priority Data

Aug. 5, 2008 (JP) ..... 2008-202001

(51) Int. Cl.
*B41J 2/01* (2006.01)

(52) U.S. Cl. ..... 347/105; 347/102; 347/100

(58) Field of Classification Search ..... 347/100, 347/101, 105, 102, 95; 428/195, 32.1; 106/31.6, 106/31.27, 31.13
See application file for complete search history.

(56) References Cited

U.S. PATENT DOCUMENTS

| | | | | |
|---|---|---|---|---|
| 7,597,439 | B2 * | 10/2009 | Wexler et al. | 347/105 |
| 2003/0138608 | A1 * | 7/2003 | Landry-Coltrain et al. | 428/195 |
| 2006/0274134 | A1 * | 12/2006 | Taguchi | 347/96 |
| 2008/0241438 | A1 * | 10/2008 | Nakano et al. | 428/32.34 |

FOREIGN PATENT DOCUMENTS

| | | | |
|---|---|---|---|
| JP | 9-202042 | A | 8/1997 |
| JP | 2004-188704 | A | 7/2004 |
| JP | 2005-297535 | A | 10/2005 |
| JP | 2006-111016 | A | 4/2006 |

* cited by examiner

*Primary Examiner* — Manish S Shah
(74) *Attorney, Agent, or Firm* — SOLARIS Intellectual Property Group, PLLC

(57) ABSTRACT

A method for inkjet recording capable of providing an image in which occurrence of color hue difference (color change) is suppressed irrespective of a manner of treatment, which method includes recording an image by jetting an ink by an inkjet method on an inkjet recording medium including a substrate and an ink receiving layer including inorganic fine particles and a water-soluble metal compound provided on the substrate, and drying at least the image recorded on the inkjet recording medium, wherein the inkjet recording medium includes a substrate, a first ink receiving layer including inorganic fine particles and a nitrogen-containing organic cationic polymer, and a second ink receiving layer including inorganic fine particles and a water-soluble metal compound on the substrate in this order from the substrate side, wherein the first ink receiving layer contains the nitrogen-containing organic cationic polymer by a higher content and the water-soluble metal compound by a lower content than those in the second ink receiving layer.

14 Claims, 1 Drawing Sheet

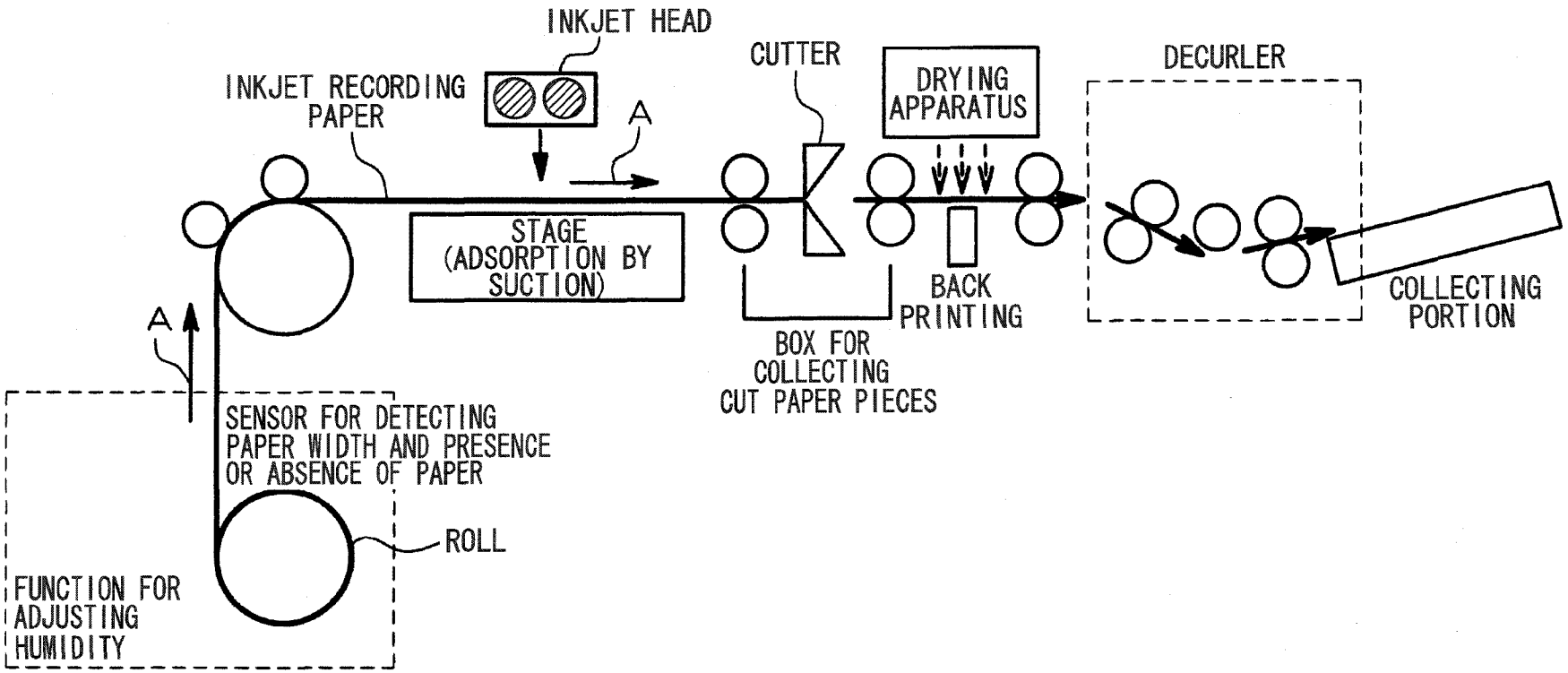
INKJET HEAD
INKJET RECORDING PAPER
A
STAGE (ADSORPTION BY SUCTION)
CUTTER
DRYING APPARATUS
BACK PRINTING
BOX FOR COLLECTING CUT PAPER PIECES
DECURLER
COLLECTING PORTION
SENSOR FOR DETECTING PAPER WIDTH AND PRESENCE OR ABSENCE OF PAPER
ROLL
A
FUNCTION FOR ADJUSTING HUMIDITY

METHOD FOR INKJET RECORDING

CROSS-REFERENCE TO RELATED APPLICATION

This application claims priority under 35 USC 119 from Japanese Patent Application No. 2008-202001 filed on Aug. 5, 2008, the disclosure of which is incorporated by reference herein.

BACKGROUND OF THE INVENTION

1. Field of the Invention

The present invention relates to a method for inkjet recording in which an image is recorded by an inkjet method.

2. Related Art

Recently, various image recording methods for recording color images have been proposed, and in all of the methods, demands with respect to qualities of recorded articles such as image quality, aesthetic property and curl after recording are high.

For example, a method for inkjet recording using an inkjet recording medium including an ink receiving recording layer having a porous structure has been put to practical use. One example of such a method uses an inkjet recording medium including a substrate and a recording layer having a high porosity and including inorganic pigment particles and a water-soluble binder provided on the substrate. Since the inkjet recording medium has a porous structure, it has an excellent rapid ink drying property, a high gloss and the like, and thereby allows recording of photograph-like images.

Inkjet techniques have been applied to the fields of office printers, home printers and the like, but recently, they are increasingly being applied to the field of commercial printing. For example, there are demands for applications such as printing of images at a high speed or in large numbers at one time, recording of images on both sides for commercial prints such as photo books, and the like. When an image is recorded by jetting an ink in such applications, not only is recording of an image having high quality and high gloss at a higher speed demanded, but also stable density and color hue of the recorded image are demanded, from the viewpoint of quality as a recording material.

However, under circumstances in which improvement in quality and performance is proceeding, there is a tendency such that the effects of a humidity environment and a drying state after recording on the image quality cannot be ignored when recording is performed at a high speed, on many sheets, by two-sided recording, or the like.

As a technique relating to the above, a technique including adhering a cationic resin to a normal paper-type sheet including a substrate as an ink receiving layer, and carrying out recording using a high speed rotary inkjet printing system using a dielectric heating apparatus such as a high-frequency heating apparatus, a microwave heating apparatus or the like as an auxiliary drying apparatus is disclosed (e.g., see Japanese Patent Application Laid-Open (JP-A) No. 9-202042).

Furthermore, examples of methods in which a heat treatment is performed after image recording are disclosed (e.g., see JP-A Nos. 2004-188704, 2005-297535 and 2006-111016).

SUMMARY OF THE INVENTION

The invention has been made in view of the above circumstances, and aims to provide a method for inkjet recording with which an image in which the density is high and the occurrence of color hue difference (color change) has been suppressed may be obtained irrespective of the manner of recording such as two-sided recording, recording on many sheets or recording at a high speed. More specifically, the invention according to an aspect of the invention provides a method for inkjet recording, comprising recording an image by applying an ink by an inkjet method onto an inkjet recording medium comprising a substrate and an ink receiving layer, the ink receiving layer comprising inorganic fine particles and a water-soluble metal compound provided on the substrate, and drying at least the image recorded on the inkjet recording medium.

BRIEF DESCRIPTION OF THE DRAWING

FIG. 1 shows a schematic constitutional drawing showing a constitutional embodiment of an inkjet printer in which image recording is performed using the method for inkjet recording of the invention.

DETAILED DESCRIPTION OF THE INVENTION

In a case, for example, where two-sided recording, recording on many sheets, recording at a high speed, or the like is performed, the sheets are sometimes stacked and then collected within a short period of time after recording. The inventors found, however, in a case where drying after recording is not necessarily sufficient, color hue difference (color change) readily occurs between the portion in which paper or the like is overlapped and the portion having no overlap.

An inkjet recording medium having an ink receiving layer that includes inorganic fine particles so as to have a porous structure is tend to be difficult to be dried since the pore size of the porous structure is decreased due to the jetting of inks. Therefore, there is a problem that color change occurs in an image or between the images, and an image having a stable color hue may not be obtained when recording is performed under a recording condition in which drying tends to become insufficient due to high speed recording or the like.

The invention has been made based on the above-mentioned problems, and the object thereof is to provide a method for inkjet recording with which an image in which the density is high and the occurrence of color hue difference (color change) has been suppressed may be obtained irrespective of the manner of recording such as two-sided recording, recording on many sheets or recording at a high speed.

The inventors found, after studying hard the problems, that the objects to solve the problems may be achieved by the following items <1> to <17>.

<1> A method for inkjet recording comprising; recording an image by applying an ink by an inkjet method onto an inkjet recording medium comprising a substrate and an ink receiving layer, the ink receiving layer comprising inorganic fine particles and a water-soluble metal compound provided on the substrate; and drying at least the image recorded on the inkjet recording medium.

<2> The method for inkjet recording according to the item <1>, wherein the inkjet recording medium comprises, on the substrate in this order from the substrate side: a first ink receiving layer comprising inorganic fine particles, a nitrogen-containing organic cationic polymer and an optional water-soluble metal compound; and a second ink receiving layer comprising inorganic fine particles, a water-soluble metal compound and an optional nitrogen-containing organic cationic polymer, wherein a content of the nitrogen-containing organic cationic polymer in the first ink receiving layer is higher than that in the second ink receiving layer, and a content of the water-soluble metal compound in the first ink receiving layer is lower than that in the second ink receiving layer.

<3> The method for inkjet recording according to the item <1> or the item <2>, wherein the inorganic fine particles are selected from the group consisting of silica fine particles, alumina fine particles and pseudo boehmite.

<4> The method for inkjet recording according to any one of the items <1> to <3>, wherein the water-soluble metal compound is a water-soluble aluminum compound.

<5> The method for inkjet recording according to any one of the items <1> to <4>, wherein the drying is performed by providing heat in an amount of 2 kJ or less per 102 mm×152 mm.

<6> The method for inkjet recording according to any one of the items <1> to <5>, wherein the drying is performed by dielectric heating.

<7> The method for inkjet recording according to any one of the items <1> to <5>, wherein the drying is performed by infrared heating.

<8> The method for inkjet recording according to the item <6>, wherein the dielectric heating in the drying is performed by microwave heating.

<9> The method for inkjet recording according to any one of the items <1> to <8>, wherein the drying is started within 20 seconds from the completion of the jetting of the ink in the recording of the image.

<10> The method for inkjet recording according to any one of the items <1> to <9>, wherein the maximum total ejection amount of the ink is from 10 mL/$m^2$ to 36 mL/$m^2$.

<11> The method for inkjet recording according to any one of the items <1> to <10>, wherein the ink is a dye-containing ink comprising a dye as a colorant.

<12> The method for inkjet recording according to the item <2>, wherein the content ratio of the nitrogen-containing organic cationic polymer in the second ink receiving layer with respect to the first ink receiving layer is from 0 to 0.8, and the content ratio of the water-soluble metal compound in the first ink receiving layer with respect to the second ink receiving layer is from 0 to 0.8.

<13> The method for inkjet recording according to the item <2> or the item <12>, wherein the nitrogen-containing organic cationic polymer comprises particles of a cationic polyurethane resin.

<14> The method for inkjet recording according to any one of the items <1> to <13>, wherein the ink receiving layer further comprises a water-soluble resin.

<15> The method for inkjet recording according to any one of the items <2>, <12>, or <13>, wherein at least the first ink receiving layer further comprises a sulfur-containing compound, and a content of the sulfur-containing compound in the first ink receiving layer is higher than that in the second ink receiving layer.

<16> The method for inkjet recording according to the item <15>, wherein the sulfur-containing compound is a thioether compound or a sulfoxide compound.

<17> The method for inkjet recording according to the items <15> or <16>, wherein the content ratio of the sulfur-containing compound in the second ink receiving layer with respect to the first ink receiving layer is from 0 to 0.6.

Hereinafter the method for inkjet recording of the invention is explained in detail.

The method for inkjet recording of the invention includes at least an image recording process in which an image is recorded by jetting an ink by an inkjet method on an inkjet recording medium and a drying process in which the image is dried, wherein the image is recorded by jetting the ink on the inkjet recording medium having a substrate and an ink receiving layer including inorganic fine particles and a water-soluble metal compound provided on the substrate, in the image recording process, and at least the image recorded on the inkjet recording medium is dried in the drying process.

Generally, it is deduced that an ink receiving layer including inorganic fine particles so as to have a porous structure has a decreased pore size due to jetting of an ink, and in such case, drying is considered to be difficult to proceed. Therefore, it is deduced that the constitution of the invention, in which an image is recorded by using an ink receiving layer having a specific laminate structure and a component composition and the thus-obtained image is dried, suppresses the decrease in the pore size of the porous structure after jetting of the ink to keep the state in which the solvent is readily transferred, and readily accelerates the drying, whereby the burden of drying is alleviated and the color change in the image from immediately after recording is suppressed. Furthermore, since the color change is suppressed even the sheets are stacked within a short time period after drying, continuous recording is readily performed and the productivity is improved.

Hereinafter the processes that constitute the method for inkjet recording of the invention are explained in detail.

[Image Recording Process]

In the image recording process, an image is recorded by jetting an ink by an inkjet method on an inkjet recording medium having a substrate and an ink receiving layer including inorganic fine particles and a water-soluble metal compound on the substrate (hereinafter sometimes referred to as "inkjet recording medium of the invention").

In this process, it is preferable that an image is recorded by jetting the ink on the inkjet recording medium of the invention, i.e., the inkjet recording medium including, on the substrate, and a first ink receiving layer including inorganic fine particles, a nitrogen-containing organic cationic polymer and an optional water-soluble metal compound and a second ink receiving layer including inorganic fine particles, a water-soluble metal compound (preferably a water-soluble aluminum compound) and an optional nitrogen-containing organic cationic polymer in this order from the substrate side, wherein a content of the nitrogen-containing organic cationic polymer in the first ink receiving layer is higher than that in the second ink receiving layer, and a content of the water-soluble metal compound in the first ink receiving layer is lower than that in the second ink receiving layer.

The inkjet method is not specifically limited, and known modes such as an electric charge controlling mode in which an ink is jetted by utilizing electrostatic inducing force, a drop-on-demand mode that utilizes oscillation pressure of a piezo element (pressure pulse mode), an acoustic inkjet mode in which an electric signal is converted to an acoustic beam and an ink is jetted by irradiating the acoustic beam to the ink and utilizing the radiation pressure, a thermal inkjet (bubble jet (registered trademark)) mode that utilizes the pressure generated upon formation of bubbles by heating an ink, or the like may be used. Specific inkjet method is the method described in JP-A No. 54-59936, in which the volume of the ink is rapidly changed by the action of heat energy and the ink is jetted from a nozzle by the action of this state change, may be effectively used.

The inkjet method also includes a mode for jetting an ink having a low concentration, which is referred to as a photo ink, in many small volumes, a mode for improving image quality using a plurality of inks having substantially the same hues and different concentrations, and a mode using a colorless transparent ink.

The inkjet head used in the inkjet method may be of an on-demand mode or continuous mode. Furthermore, specific examples of the jetting mode may include an electromechanical converting mode (e.g., a single cavity type, a double cavity type, a vendor type, a piston type, a share mode type, a shared wall type or the like), an electric-thermal converting mode (e.g., a thermal inkjet type, a bubble jet (registered trademark) type or the like), an electrostatic drawing mode (e.g., an electrical field control type, a slit jet type or the like), a discharging mode (e.g., a spark jet type or the like), and the like, and any jetting mode may be used.

The ink nozzle and the like used in the recording by the inkjet method are not specifically limited, and may be suitably selected according to the purpose.

As the inkjet head, a shuttle mode in which recording is carried out by using a short serial head while the head is scanned in the direction of the width of the recording medium, as well as a line mode using a line head in which recording elements are arranged according to the whole area of one side of the recording medium may be applied. In the line mode, image recording may be performed on the whole surface of the recording medium by scanning the recording medium in the direction orthogonal to the direction of the arrangement of the recording elements, and a recording speed higher than that of the shuttle mode may be realized since only the recording medium is transferred.

The amount of the droplets of the ink jetted from the inkjet head is preferably from 0.2 pL to 10 pL (picolitter), and more preferably from 0.4 pL to 5 pL, from the viewpoints that the effect of alleviating the burden of drying is high and the color change in the image is effectively suppressed.

The maximum total ejection amount of the ink jetted at image recording is preferably from 10 mL/m$^2$ to 36 mL/m$^2$, and more preferably from 15 mL/m$^2$ to 30 mL/m$^2$, from the viewpoints that the effect of alleviating the burden of drying is high and the color change in the image is effectively suppressed.

The maximum total ejection amount [mL/m$^2$] is the total maximum amount of the ejection amount of each ink per a unit area in the apparatus used, and is calculated from the following equation.

Maximum total ejection amount=maximum ejection amount of one dot [mL/m$^2$]×total ink amount [%] [total ink amount: total of actual ejection amount ($a$ %) of each ink to predetermined ejection amount ($A$ %) of each of color inks [e.g.: Y (yellow), M (magenta), C (cyan) and K (black)]].

For example, when the predetermined ejection amount (A %) for each of the four colors YMCK in the apparatus is 100% (the predetermined value for 4 colors is 400% at maximum), for example, when the actual ejection amount (a %) at recording of a gray image is, for example, Y=M=C=K=30%, the ink total amount is 120%, and when the maximum ejection amount for one dot is, for example, 20 mL/m$^2$, the maximum total ejection amount in this case is 20×1.2=24 mL/m$^2$.

—Inkjet Recording Medium—

Next, the inkjet recording medium of the invention is explained.

The inkjet recording medium of the invention includes a substrate and an ink receiving layer including inorganic fine particles and a water-soluble metal compound provided on the substrate. The inkjet recording medium of the invention may be constituted to be a laminate structure having two or more layers by adding other ink receiving layers besides the ink receiving layer.

It is preferable that the inkjet recording medium of the invention has a structure including, on a substrate, a first ink receiving layer including inorganic fine particles and a nitrogen-containing organic cationic polymer, and a second ink receiving layer including inorganic fine particles and a water-soluble aluminum compound on the substrate in this order from the substrate side, wherein a content of the nitrogen-containing organic cationic polymer in the first ink receiving layer is higher than that in the second ink receiving layer, and a content of the water-soluble metal compound in the first ink receiving layer is lower than that in the second ink receiving layer.

In this case, a laminate of two or more layers including the first ink receiving layer and the second ink receiving layer is formed, and the laminate is constituted so that the content of the nitrogen-containing organic cationic polymer in the first ink receiving layer (hereinafter also referred to as "first layer"), that is the layer on the side closer to the substrate, is higher than that in the second ink receiving layer (hereinafter also referred to as the "second layer") that is the layer on the side farther from the substrate, and the content of the water-soluble aluminum compound in the first layer is lower than that in the second layer.

When the laminate is constituted so that the content of the nitrogen-containing organic cationic polymer in the first layer is higher than that in the second layer, high image density and ozone resistance may be obtained. Furthermore, when the laminate is formed so that the content of the water-soluble aluminum compound in the first layer is lower than that in the second layer, the state of the surface becomes good since occurrence of cracking or the like is avoided, and the ozone resistance is further improved.

In the invention, the existence distribution of the nitrogen-containing organic cationic polymer in the ink receiving layer may be confirmed by an elemental analysis. Specifically, it is only necessary to perform a mapping analysis by SEM-EDX method and observe the obtained image. In this case, the existence position of the whole ink receiving layer is confirmed by a mapping analysis of the main component (e.g., Si element) of the ink receiving layer, a mapping analysis of N element is then performed, and which of the amount of the N element in the first ink receiving layer that is on the side closer to the substrate and that in the second ink receiving layer that is on the side farther from the substrate in the ink receiving layer is higher is determined from a mapping image.

The existence distribution of the water-soluble aluminum compound in the ink receiving layer may also be confirmed in a similar manner.

In the invention, the content ratio [the content in the second ink receiving layer/the content in the first ink receiving layer] of the nitrogen-containing organic cationic polymer in the ink receiving layer is preferably less than 1.0. The content ratio is preferably from 0 to 0.8, and more preferably from 0 to 0.4, from the viewpoints of color change from immediately after recording, color density and ozone resistance.

The ink receiving layer including the nitrogen-containing organic cationic polymer at the above content ratio may be formed, for example, by constituting the content ratio of the nitrogen-containing organic cationic polymer [content in the second coating solution/content in the first coating solution] as mentioned above in the below-mentioned production method of the inkjet recording medium.

The content percentage of the nitrogen-containing organic cationic polymer in the first layer is preferably from 2% by mass to 25% by mass, more preferably from 4% by mass to 20% by mass, and even more preferably from 6% by mass to 18% by mass, with respect to the total solids of the first layer, from the viewpoints of color density and ozone resistance. Furthermore, the content of the nitrogen-containing organic cationic polymer in the second layer is preferably from 1% by mass to 20% by mass, more preferably from 2% by mass to 15% by mass, and even more preferably from 4% by mass to 12% by mass, with respect to the total solids of the second layer, from the viewpoints of color density and ozone resistance. Moreover, the content of the nitrogen-containing organic cationic polymer in the whole ink receiving layer including the first and second layers is preferably from 1% by mass to 15% by mass, more preferably from 1.5% by mass to 12% by mass, and even more preferably from 2% by mass to 10% by mass, with respect to the total solids of the whole ink receiving layer, from the viewpoints of color density and ozone resistance.

In the invention, the total solids of the ink receiving layer refers to the all components except water in the composition that constitutes the ink receiving layer.

Furthermore, it is preferable that the ratio of the amount of nitrogen-containing organic cationic polymer/the amount of inorganic fine particles in the first layer is higher than the ratio of the amount of nitrogen-containing organic cationic polymer/the amount of inorganic fine particles in the second layer, from the viewpoint of obtaining the effect of the invention more effectively.

In the invention, the content ratio [the content in the first ink receiving layer/the content in the second ink receiving layer] of the water-soluble aluminum compound in the ink receiving layer is preferably less than 1.0. The content ratio is preferably from 0 to 0.8, and more preferably from 0 to 0.4, from the viewpoint of obtaining the effect of the invention more effectively.

The ink receiving layer including the water-soluble aluminum compound at the above content ratio may be formed, for example, by constituting the content ratio of the water-soluble aluminum compound [content in the second coating solution/content in the first coating solution] as mentioned above in the below-mentioned production method of the inkjet recording medium.

The content of the water-soluble aluminum compound in the second layer is preferably from 2% by mass to 25% by mass, more preferably from 4% by mass to 20% by mass, and even more preferably from 6% by mass to 18% by mass, with respect to the total solids of the second layer, from the viewpoints that the state of the surface becomes good since the occurrence of cracking and the like are avoided, and that the ozone resistance is improved. Furthermore, the content of the water-soluble aluminum compound in the first layer of the ink receiving layer is preferably from 1% by mass to 20% by mass, more preferably from 2% by mass to 15% by mass, and even more preferably from 4% by mass to 12% by mass, with respect to the total solids of the first layer, from the viewpoint of obtaining the effect of the invention more effectively.

Moreover, the content of the water-soluble aluminum compound in the whole ink receiving layer including the first and second layers is preferably from 1% by mass to 15% by mass, more preferably from 1.5% by mass to 12% by mass, and even more preferably from 2% by mass to 10% by mass, with respect to the total solids of the whole ink receiving layer, from the viewpoint of obtaining the effect of the invention more effectively.

Moreover, it is preferable that, among the ink receiving layers provided on the substrate, the outermost layer that is the farthest from the substrate includes colloidal silica, from the viewpoint of improvement of the gloss of the ink receiving layer, and the like. Hereinafter the outermost layer including colloidal silica is also referred to as the "colloidal silica layer".

It is preferable that the layer thickness of the ink receiving layer is determined with respect to the relation with the porosity in the layer, from the viewpoint of obtaining an absorption volume that allows absorption of all droplets. For example, when the amount of the ink is 8 mL/mm$^2$ and the porosity is 60%, a film having a layer thickness of about 15 μm or more is required. Considering this fact, the layer thickness of the ink receiving layer is preferably from 10 μm to 50 μm, and more preferably from 20 μm to 40 μm.

Furthermore, the layer thicknesses of the first layer and the second layer in the invention are each preferably from 5 μm to 25 μm, and more preferably from 10 μm to 20 μm. The layer thickness of the colloidal silica layer is preferably from 0.05 μm to 5 μm, and more preferably from 0.1 μm to 3 μm, from the viewpoints of ink absorbency and gloss.

The pore diameter of the porous structure in the ink receiving layer is preferably from 0.005 μm to 0.030 μm, and more preferably from 0.01 μm to 0.025 μm by a median diameter.

The porosity and pore median diameter may be measured using a mercury porosimeter (trade name: PORESIZER 9320-PC2, manufactured by Shimadzu Corporation).

It is preferable that the ink receiving layer is excellent in light-transmitting property, and as a measure thereof, the haze value where the ink receiving layer is formed on a transparent film substrate is preferably 30% or less, more preferably 20% or less as a measure of the light-transmitting property.

The haze value may be measured using a haze meter (trade name: HGM-2DP, manufactured by Suga Test Instruments Co., Ltd.).

Components which constitute the ink receiving layer of the present invention will be described below.

(Inorganic Fine Particles)

The ink receiving layer, which includes the first ink receiving layer and the second ink receiving layer, in the present invention contains at least one type of inorganic fine particles as an essential component.

The inorganic fine particles have a function of enhancing ink absorbency by creating a porous structure in a case where the ink receiving layer is formed with them.

It is preferable that the solid content of the inorganic fine particles in the ink receiving layer is 50% by mass or higher, and more preferably 60% by mass or higher, because it becomes possible to create a better porous structure, and to contribute to the formation of an inkjet recording medium with sufficient ink absorbency. Herein, the expression "solid content" of fine particles in the ink receiving layer refers to the content of fine particles calculated on the basis of all ingredients except water in the composition for the ink receiving layer.

Examples of inorganic fine particles for use in the invention include silica fine particles, colloidal silica, titanium dioxide, barium sulfate, calcium silicate, zeolite, kolinite, hollysite, mica, talc, calcium carbonate, magnesium carbonate, calcium sulfate, pseudo boehmite, zinc oxide, zinc hydroxide, alumina, aluminum silicate, magnesium silicate, zirconium oxide, zirconium hydroxide, cerium oxide, lanthanum oxide and yttrium oxide. Among these substances, silica fine particles, colloidal silica, alumina fine particles and pseudo boehmite are preferred from the viewpoint of creating good porous structure. The inorganic fine particles may be used as they are primary particles, or in a state that they are formed into secondary particles. The average primary particle diameter of the inorganic fine particles is preferably 2 μm or less, and more preferably 200 nm or less.

Moreover, silica fine particles having an average primary particle diameter of 30 nm or less, colloidal silica having an average primary particle diameter of 30 nm or less, alumina fine particles having an average primary particle diameter of 20 nm or less and pseudo boehmite having an average pore radius of from 2 nm to 15 nm are more preferable, and silica fine particles, alumina fine particles and pseudo boehmite are particularly preferable.

Silica fine particles are usually roughly classified into wet method particles and dry method (vapor-phase process) particles in accordance with the method of manufacturing thereof. In the mainstream of the wet method, silica fine particles are mainly produced by generating an active silica by acid decomposition of a silicate, appropriately polymerizing the active silica, and performing aggregation precipitation of the resulting polymeric silica to obtain hydrated silica. On the other hand, in the mainstream of the gas phase process, silica (anhydrous silica) particles are produced by either a method having high-temperature gas-phase hydrolysis of a silicon halide (flame hydrolysis process), or a method having reductively heating and vaporizing quartz and coke in an electric furnace, applying an arc discharge and oxidizing the vaporized silica with air (arc method). The "vapor-phase process silica" means a silica (an anhydrous silica fine particle) produced by the gas phase process. Vapor-phase process silica fine particles are particularly preferable as the silica fine particles used in the invention.

While the above vapor-phase process silica differs from hydrated silica in terms of the density of silanol groups on its surfaces, the presence or not of voids therein, and the like, and different properties are exhibited from each other, vapor-phase process silica is suitable for forming three-dimensional structures which have a high porosity. While the reason for this is not clearly understood, it can be supposed as follows. Namely, hydrated silica fine particles have a high density of silanol groups on the surface, at from 5 per $nm^2$ to 8 per $nm^2$, thus the silica fine particles tend to coagulate (aggregate) densely. In contrast, vapor-phase process silica particles have a lower density of silanol groups on the surface, at from 2 per $nm^2$ to 3 per $nm^2$, thus vapor-phase process silica seems to form less compact, loose coagulations (flocculations), consequently leading to structures with a higher porosity.

The vapor-phase process silica has a particularly large specific surface, high ink absorbency and retention efficiency, and a low refractive index. Therefore, the vapor-phase process silica has features such that it can impart transparency to the ink receiving layer and ensure high color densities and good color forming property as long as dispersion thereof is performed until it comes to have appropriate particle diameters. It is important for the ink receiving layer to be transparent from the viewpoint of delivering high color densities and good formed-color gloss in not only transparency-required uses, such as OHP, but also applications to recording media, such as gloss photo paper.

An average primary particle diameter of the vapor-phase process silica particles is preferably 30 nm or less, more preferably 20 nm or less, particularly preferably 10 nm or less, and most preferably in a range of from 3 nm to 10 nm. Since the vapor-phase process silica particles easily adhere to each other by hydrogen bonds due to the silanol groups, a structure having a high porosity can be formed thereby when the average primary particle size is 30 nm or less, whereby the ink absorption characteristic can be effectively improved.

The silica fine particles may be used in combination with other fine particles described above. When the other fine particles are used in combination with the vapor-phase process silica, the amount of the vapor-phase silica with respect to the total amount of fine particles is preferably 30% by mass or higher, and more preferably 50% by mass or higher.

Preferable examples of inorganic fine particles which can be additionally used in the invention include alumina fine particles, alumina hydrate, and mixtures or complexes thereof. Among them, alumina hydrate is further preferable, as it absorbs and holds inks well. Pseudo-boehmite ($Al_2O_3.nH_2O$) is particularly preferable. Alumina hydrate may be used in a variety of forms. Alumina hydrate is preferably prepared by using boehmite in the sol state as the starting material, as it easily provides smoother layers.

An average pore radius of pseudo-boehmite is preferably in a range of from 1 nm to 30 nm and more preferably in a range of from 2 nm to 15 nm. The pore volume thereof is preferably in a range of from 0.3 mL/g to 2.0 mL/g, and more preferably in a range of from 0.5 mL/g to 1.5 mL/g. The pore radius and the pore volume are determined by the nitrogen absorption-desorption method. These values may be determined, for example, using a gas absorption-desorption analyzer (e.g., trade name: OMNISORP 369, manufactured by Beckman Coulter, Inc.).

Among the alumina fine particles, vapor-phase process alumina fine particles are preferred because of large specific surface. The average primary particle diameter of the vapor-phase process alumina is preferably 30 nm or less, and more preferably 20 nm or less.

In application of the fine particles as described above to an inkjet recording medium, each of the embodiments disclosed in JP-A Nos. 10-81064, 10-119423, 10-157277, 10-217601 and 11-348409, JP-A Nos. 2001-138621, 2000-43401, 2000-211235, 2000-309157, 2001-96897 and 2001-138627, JP-A Nos. 11-91242, 8-2087, 8-2090, 8-2091, 8-2093, 8-174992 and 11-192777, and JP-A No. 2001-301314 can be used as one embodiment of the present invention.

A content of the inorganic fine particles in the ink receiving layer is preferably from 50% by mass to 90% by mass, and more preferably from 60% by mass to 80% by mass with respect to the total solids of the ink receiving layer.

(Water-Soluble Metal Compound)

The ink receiving layer of the invention (at least the second ink receiving layer in the case where the ink receiving layer includes a first ink receiving layer and a second ink receiving layer in this order from the substrate side) includes at least one water-soluble metal compound.

Examples of the water-soluble metal compound may include water-soluble salts of metals selected from the group consisting of calcium, barium, manganese, copper, cobalt, nickel, aluminum, iron, zinc, zirconium, chromium, tungsten and molybdenum.

Among the above-mentioned water-soluble polyvalent metal compounds, compounds including a metal having a valency of three or more are preferable, aluminum compounds, or compounds including a metal belonging to group 4A of the periodic table (e.g., zirconium, titanium or the like) are preferable, and aluminum compounds are more preferable. Water-soluble aluminum compounds are specifically preferable.

In the invention, an exemplary embodiment wherein at least one water-soluble aluminum compound is included in the second ink receiving layer in the case where the ink receiving layer includes a first ink receiving layer and a second ink receiving layer in this order from the substrate side is preferable. In this case, the water-soluble aluminum compound may be included in the first ink receiving layer to the extent that the effect of the invention is not deteriorated.

As for the water-soluble aluminum compounds, for example, aluminum chloride or hydrates thereof (such as aluminum chloride hexahydrate), aluminum sulfate or hydrates thereof, aluminum alum, aluminum sulfite, aluminum thiosulfate, aluminum nitrate nonahydrate, aluminum acetate, aluminum lactate, and basic aluminum thioglycolate are known. In addition to these salts, basic polyaluminum hydroxide compounds as inorganic aluminum-containing cationic polymers (hereafter sometimes referred to as basic polyaluminum chloride or polyaluminum chloride) are also known, and can be preferably used.

The term "basic polyaluminum hydroxide compounds" described above refers to water-soluble polyaluminum hydroxides whose main components are represented by the following Formula a, b or c, and stably containing a basic polymeric polynuclear condensed ion, such as $[Al_6(OH)_{15}]^{3+}$, $[Al_8(OH)_{20}]^{4+}$, $[Al_{13}(OH)_{34}]^{5+}$ or $[Al_{21}(OH)_{60}]^{3+}$.

$$[Al_2(OH)_nCl_{6-n}]_m \quad \text{Formula a}$$

$$[Al(OH)_3]_nAlCl_3 \quad \text{Formula b}$$

$$Al_n(OH)_mCl_{(3n-m)}, 0 \leqq m \leqq 3n \quad \text{Formula c}$$

Such basic polyaluminum hydroxide compounds are available from TAKI CHEMICAL CO., LTD. as a water treatment chemical under the trade name of Polyaluminum Chloride (PAC), Asada Chemical Industry Co., Ltd. under the trade name of Polyaluminum Hydroxide (Paho), rikengreen Co., Ltd. under the trade name of HAP-25, TAIMEI Chemicals Co., Ltd. under the trade name of ALFINE 83, or other makers as products developed with intentions similar to the above, and they are easy to get various grades of products for.

Examples of water-soluble metal compounds other than aluminum compounds include calcium acetate, calcium chloride, calcium formate, calcium sulfate, calcium butyrate, barium acetate, barium sulfate, barium phosphate, barium oxalate, barium naphtoresorcincarboxylate, barium butyrate, manganese chloride, manganese acetate, manganese formate dihydrate, ammonium manganese sulfate hexahydrate, cupper(II) chloride, ammonium cupper(II) chloride dihydrate, copper sulfate, copper(II) butyrate, copper oxalate, copper phthalate, copper citrate, copper gluconate, copper naphthenate, cobalt chloride, cobalt thiocyanate, cobalt sulfate, cobalt (II) acetate, cobalt naphthenate, nickel sulfate hexahydrate, nickel chloride hexahydrate, nickel acetate tetrahydrate, ammonium nickel sulfate hexahydrate, nickel amidosulfate tetrahydrate, nickel sulfaminate, nickel 2-ethylhexanoate, ferrous bromide, ferrous chloride, ferric chloride, ferrous sulfate, ferric sulfate, iron(III) citrate, iron(III) lactate trihydrate, triammonium iron(III) trioxalate trihydrate, zinc bromide, zinc chloride, zinc nitrate hexahydrate, zinc sulfate, zinc acetate, zinc lactate, zirconium acetate, zirconyl acetate, zirconium tetrachloride, zirconium chloride, zirconium oxychloride octahydrate, zirconium hydroxychloride, chromium acetate, chromium sulfate, sodium phosphotungstate, sodium tungsten citrate, dodecatungstophosphoric acid n-hydrate, dodecatungstosilicic acid hexacosahydrate, molybdenum chloride, dodecamolybdophosphoric acid n-hydrate, zinc phenolsulfonate, ammonium zinc acetate, and ammonium zinc carbonate. These water-soluble polyvalent metal compounds may be used in a combinations of two or more of them. The expression "water-soluble" in the term "water-soluble polyvalent metal compound" means that the polyvalent metal compound can be dissolved in water at 20° C. in a concentration of 1% by mass or more.

As the water-soluble compounds a metal belonging to group 4A of the periodic table, titanium- or zirconium-containing water-soluble compounds are preferred. Examples of a titanium-containing water-soluble compound include titanium chloride, titanium sulfate, titanium tetrachloride, tetraisopropyl titanate, titanium acetylacetonate, and titanium lactate. Examples of a zirconium-containing water-soluble compound include zirconium acetate, zirconyl acetate, zirconium chloride, zirconium hydroxychloride, zirconium nitrate, zirconyl nitrate, basic zirconium carbonate, zirconium hydroxide, zirconium lactate, zirconyl lactate, ammonium zirconium carbonate, potassium zirconium carbonate, ammonium zirconyl carbonate, potassium zirconyl carbonate, zirconium sulfate, zirconium fluoride, zirconyl sulfate, and zirconyl fluoride.

A content of the water-soluble polyvalent metal compound (preferably water-soluble aluminum compound) in the ink receiving layer (at least in the second ink receiving layer in the case where a first ink receiving layer and a second ink receiving layer are formed in this order from the substrate side) is preferably from 0.1% by mass to 10% by mass, more preferably from 0.5% by mass to 8% by mass, with respect to the inorganic fine particles, in view of ozone resistance.

(Nitrogen-containing Organic Cationic Polymer)

The ink receiving layer in the invention preferably includes the nitrogen-containing organic cationic polymer. Specifically, when the ink receiving layer is constituted to be a laminate structure of two or more layers, the first ink receiving layer includes at least one nitrogen-containing organic cationic polymer. The nitrogen-containing organic cationic polymer may also be included in the second ink receiving layer to the extent that the effect of the invention is not deteriorated. By incorporating the nitrogen-containing organic cationic polymer, bleeding of the recorded image may be suppressed, and silica may be dispersed.

Although the nitrogen-containing organic cationic polymer is not specifically limited, a polymer having a primary to tertiary amino group or a quaternary ammonium base is preferable. Examples of the nitrogen-containing organic cationic polymer may include a nitrogen-containing organic cationic polymer, which is a homopolymer of a monomer having a primary to tertiary amino group or a salt thereof, or a quaternary ammonium base (nitrogen-containing organic cation monomer), a nitrogen-containing organic cationic polymer obtained as a copolymer or condensate of the above nitrogen-containing organic cation monomer and other monomer, a nitrogen-containing organic cationic polymer obtained by cationating a conjugate diene copolymer such as a styrene-butadiene copolymer or a methyl methacrylate-butadiene copolymer; an acrylic polymer such as a polymer or copolymer of an acrylic acid ester and a methacrylic acid ester, or a polymer or copolymer of acrylic acid and methacrylic acid; a styrene-acrylic polymer such as a styrene-acrylic acid ester copolymer or a styrene-methacrylic acid ester copolymer; a vinyl polymer such as an ethylene-vinyl acetate copolymer; an urethane polymer having urethane bonds or the like with a compound including a cationic group, and the like.

Examples of the nitrogen-containing organic cationic monomer include trimethyl-p-vinylbenzylammonium chloride, trimethyl-m-vinylbenzylammonium chloride, triethyl-p-vinylbenzylammonium chloride, triethyl-m-vinylbenzylammonium chloride, N,N-dimethyl-N-ethyl-N-p-vinylbenzylammonium chloride, N,N-diethyl-N-methyl-N-p-vinylbenzylammonium chloride, N,N-dimethyl-N-n-propyl-N-p-vinylbenzylammonium chloride, N,N-dimethyl-N-n-octyl-N-p-vinylbenzylammonium chloride, N,N-dimethyl-N-benzyl-N-p-vinylbenzylammonium chloride, N,N-diethyl-N-benzyl-N-p-vinylbenzylammonium chloride, N,N-dimethyl-N-(4-methyl)benzyl-N-p-vinylbenzylammonium chloride, N,N-dimethyl-N-phenyl-N-p-vinylbenzylammonium chloride, trimethyl-p-vinylbenzylammonium bromide, trimethyl-m-vinylbenzylammonium bromide, trimethyl-p-vinylbenzylammonium sulfonate, trimethyl-m-vinylbenzylammonium sulfonate, trimethyl-p-vinylbenzylammonium acetate, trimethyl-m-vinylbenzylammonium acetate, N,N,N-triethyl-N-2-(4-vinylphenyl)ethylammonium chloride, N,N,N-triethyl-N-2-(3-vinylphenyl)ethylammonium chloride, N,N-diethyl-N-methyl-N-2-(4-vinylphenyl)ethylammonium chloride, N,N-diethyl-N-methyl-N-2-(4-vinylphenyl)ethylammonium acetate, quaternarized products prepared by reacting N,N-dimethylaminoethyl (meth)acrylate, N,N-diethylaminoethyl (meth) acrylate, N,N-dimethylaminopropyl (meth)acrylate, N,N-diethylaminopropyl (meth)acrylate, N,N-dimethylaminoethyl (meth)acrylamide, N,N-diethylaminoethyl (meth)acrylamide, N,N-dimethylaminopropyl (meth)acrylamide or N,N-diethylaminopropyl (meth)acrylamide with methyl chloride, ethyl chloride, methyl bromide, ethyl bromide, methyl iodide or ethyl iodide, and sulfonates, alkylsulfonates, acetates or alkylcarboxylates obtained by anion substitution of these quaternarized products.

Examples of such products include monomethyldiallylammonium chloride, trimethyl-2-(methacryloyloxy)ethylammonium chloride, triethyl-2-(methacryloyloxy)ethylammonium chloride, trimethyl-2-(acryloyloxy)ethylammonium chloride, triethyl-2-(acryloyloxy)ethylammonium chloride, trimethyl-3-(methacryloyloxy)propylammonium chloride, triethyl-3-(methacryloyloxy)propylammonium chloride, trimethyl-2-(methacryloylamino)ethylammonium chloride, triethyl-2-(methacryloylamino)ethylammonium chloride, trimethyl-2-(acryloylamino)ethylammonium chloride, triethyl-2-(acryloylamino)ethylammonium chloride, trimethyl-3-(methacryloylamino)propylammonium chloride, triethyl-3-(methacryloylamino)propylammonium chloride, triethyl-3-(acryloylamino)propylammonium chloride, triethyl-3-(acryloylamino)propylammonium chloride, N,N-dimethyl-N-ethyl-2-(methacryloyloxy)ethylammonium chloride, N,N-diethyl-N-methyl-2-(methacryloyloxy)ethylammonium chloride, N,N-dimethyl-N-ethyl-3-(acryloylamino) propylammonium chloride, trimethyl-2-(methacryloyloxy) ethylammonium bromide, trimethyl-3-(acryloylamino) propylammonium bromide, trimethyl-2-(methacryloyloxy) ethylammonium sulfonate and trimethyl-3-(acryloylamino) propylammonium acetate. In addition to the monomers described above, N-vinylimidazole and N-vinyl-2-methylimidazole can be used as monomers copolymerizable with these monomers. Moreover, it is possible to utilize polymers having vinylamine units converted from their original polymerizing units, such as N-vinylacetamide and N-vinylformamide, by hydrolysis after polymerization, and the polymers having salt-form units converted from these vinylamine units.

As other monomers copolymerizable (polycondensatable) with the nitrogen-containing organic cationic monomers as described above, monomers having neither basic nor cationic moieties, such as primary, secondary and tertiary amino groups, their salts, or quaternary ammonium bases, and showing no or substantially weak interaction with dyes in inkjet ink can be used. Examples of such comonomers include alkyl esters of (meth)acrylic acid; cycloalkyl esters of (meth) acrylic acid, such as cyclohexyl (meth)acrylate; aryl esters of (meth)acrylic acid, such as phenyl (meth)acrylate; aralkyl esters, such as benzyl (meth)acrylate; aromatic vinyl compounds, such as styrene, vinyltoluene and α-methylstyrene; vinyl esters, such as vinyl acetate, vinyl propionate and vinyl versatates; allyl esters, such as allyl acetate; halogen-containing monomers, such as vinylidene chloride and vinyl chloride; vinyl cyanides, such as (meth)acrylonitrile; and olefins, such as ethylene and propylene.

The alkyl esters of (meth)acrylic acid are preferably those containing 1 to 18 carbon atoms in their respective alkyl moieties, with specific examples including methyl (meth) acrylate, ethyl (meth)acrylate, propyl (meth)acrylate, isopropyl (meth)acrylate, n-butyl (meth)acrylate, isobutyl (meth) acrylate, t-butyl (meth)acrylate, hexyl (meth)acrylate, octyl (meth)acrylate, 2-ethylhexyl (meth)acrylate, lauryl (meth) acrylate and stearyl (meth)acrylate. Among these (meth)acrylates, methyl acrylate, ethyl acrylate, methyl methacrylate, ethyl methacrylate and hydroxyethyl methacrylate are preferred. The monomers other than these acrylates and methacrylates can be used alone or in a combination of two or more of them.

Examples of the monomer that constitute the urethane polymer include a polyvalent isocyanate compound having two or more isocyanate groups (e.g., 2,4-tolylene diisocyanate, 2,6-tolylene diisocyanate, m-phenylene diisocyanate, 4,4'-diphenylmethane diisocyanate, hexamethylene diisocyanate, octamethylene diisocyanate, 1,4-cyclohexylene diisocyanate, isophorone diisocyanate, 1,3-bis(isocyanatomethyl) cyclohexane, 1,5-diisocyanato-2-methylpentane, hydrogenated xylylene diisocyanate, hydrogenated 4,4'-diphenylmethane diisocyanate or the like), and a compound that may form an urethane bond upon reacting with an isocyanato group (e.g., a polyol compound such as glycerine, 1,6-hexanediol, triethanolamine, polypropylene glycol, polyethylene glycol, bisphenol A or hydroquinone; succinic acid, adipic acid, azelaic acid, sebacic acid, dodecanedicarboxylic acid, maleic anhydride, fumaric acid, 1,3-cyclopentanedicarboxylic acid, 1,4-cyclohexanedicarboxylic acid, terephthalic acid, isophthalic acid, phthalic acid, 1,4-naphthalenedicarboxylic acid, 2,5-naphthalenedicarboxylic acid, 2,6-naphthalenedicarboxylic acid, naphthalic acid, biphenylcarboxylic acid, sorbitol, sucrose, aconitic acid, trimellitic acid, hemimellitic acid, phosphoric acid, ethylenediamine, propylenediamine, diethylenetriamine, triisopropanolamine, pyrogallol, dihydroxybenzoic acid, hydroxyphthalic acid, 1,2,3-propanetrithiol; diamines such as ethylenediamine, propylenediamine, hexamethylenediamine, phenylenediamine, tolylenediamine, diphenyldiamine, diaminodiphenylmethane, diaminocyclohexylmethane, piperazine and isophorondiamine; hydrazine; or the like).

Examples of the compound that introduces cationic groups in a copolymer or condensate that does not include a cationic group include alkyl halides, methylsulfuric acid and the like.

Among the nitrogen-containing organic cationic polymers described above, cationic polyurethanes and the cationic polyacrylates disclosed in JP-A No. 2004-167784 are preferred in view of suppression of bleeding, and cationic polyurethanes are even more preferable. Examples of commercially available products of cationic polyurethanes include SUPERFLEX 650, F-8564D and F-8570D (trade names; products of DAI-ICHI KOGYO SEIYAKU CO., LTD.), and NEOFIX IJ-150 (trade name; a product of NICCA CHEMICAL CO., LTD.).

In view of dispersibility of the inorganic fine particles, poly(diallyldimethylammonium chloride) and derivatives of poly(methacryloyloxyethyl-β-hydroxyethyldimethylammonium chloride) are preferable, and poly(diallyldimethylammonium chloride) is more preferable.

One example of a commercially available product of such polymers is SHALLOL DC902P (trade name; manufactured by DAI-ICHI KOGYO SEIYAKU CO., LTD.).

These nitrogen-containing organic cationic polymers may be used in the form of a water-soluble polymer, water-dispersible latex particles or an aqueous emulsion.

Examples of the aqueous emulsion include those obtained by cationating resin particles of such as a conjugate diene copolymer emulsion; an acrylic polymer emulsion; a styrene-acrylic polymer emulsion; a vinyl polymer emulsion; and an urethane emulsion, with a compound having a cation group; those obtained by cationating the surfaces of the emulsion particles with a cationic surfactant; those obtained by polymerizing in the presence of a cationic polyvinyl alcohol so as to distribute the polyvinyl alcohol on the surfaces of the emulsion particles; and the like.

Among these cationic emulsions, a cationic polyurethane emulsion having an urethane emulsion (urethane resin particles) as a main component (cationic polyurethane resin fine particles) is preferable.

The nitrogen-containing organic cationic polymer included in the ink receiving layer (preferably the first ink receiving layer in the case where the ink receiving layer has a first ink receiving layer and a second ink receiving layer in this order from the substrate side) is preferably a cationic polyurethane, more preferably cationic polyurethane particles (specifically, a cationic polyurethane emulsion), from the viewpoint of suppression of bleeding.

The content of the nitrogen-containing organic cationic polymer in the ink receiving layer (preferably the first ink receiving layer in the case where the ink receiving layer has a first ink receiving layer and a second ink receiving layer in this order from the substrate side) is preferably from 1% by mass to 20% by mass, more preferably from 2% by mass to 15% by mass, and even more preferably from 4% by mass to 12% by mass, with respect to the total solids of the ink receiving layer.

(Water-Soluble Resin)

The ink receiving layer in the invention preferably contains at least one water-soluble resin.

Examples of the water-soluble resin include resins having hydroxy groups as hydrophilic structural units, such as polyvinyl alcohol resins (e.g., polyvinyl alcohol (PVA), acetoacetyl-modified polyvinyl alcohol, cation-modified polyvinyl alcohol, anion-modified polyvinyl alcohol, silanol-modified polyvinyl alcohol, polyvinyl acetal), cellulose resins (e.g., methyl cellulose (MC), ethyl cellulose (EC), hydroxyethyl cellulose (HEC), carboxymethyl cellulose (CMC), hydroxypropyl cellulose (HPC), hydroxyethylmethyl cellulose, hydroxypropylmethyl cellulose), chitins, chitosans and starch; resins having ether bonds (e.g., polyethylene oxide (PEO), polypropylene oxide (PPO), polyethylene glycol (PEG), polyvinyl ether (PVE)); and resins having carbamoyl groups (e.g., polyacrylamide (PAAM), polyvinyl pyrrolidone (PVP), polyacrylic acid hydrazide).

In addition, the water-soluble resins may be resins having carboxy groups as dissociative groups, with examples including polyacrylic acid salts, maleic acid resins, alginates and gelatins.

Among these resins, at least one resin selected from the group consisting of polyvinyl alcohol resins, cellulose resins, resins having ether bonds, resins having carbamoyl groups, resins having carboxy groups and gelatins, notably polyvinyl alcohol (PVA) resins, is preferred as the water-soluble resin used in the invention.

Examples of the polyvinyl alcohol resins include the substances described in Japanese Patent Application Publication (JP-B) Nos. 4-52786, 5-67432 and 7-29479, Japanese Patent No. 2537827, JP-B No. 7-57553, Japanese Patent Nos. 2502998 and 3053231, JP-A No. 63-176173, Japanese Patent No. 2604367, JP-A Nos. 7-276787, 9-207425, 11-58941, 2000-135858, 2001-205924, 2001-287444, 62-278080 and 9-39373, Japanese Patent No. 2750433, JP-A Nos. 2000-158801, 2001-213045, 2001-328345, 8-324105, 11-348417, 58-181687, 10-259213, 2001-72711, 2002-103805, 2000-63427, 2002-308928, 2001-205919 and 2002-264489.

In addition, examples of water-soluble resins other than the polyvinyl alcohol resins include the compounds described in JP-A No. 11-165461, paragraphs [0011] and [0012], and the compounds described in JP-A Nos. 2001-205919 and 2002-264489.

These water-soluble resins may be used singly or in a combination of two or more of them. The content of the water-soluble resin is preferably from 9% by mass to 40% by mass, and more preferably from 12% by mass to 33% by mass, with respect to the total solid content of the ink receiving layer by mass.

In the invention, each of main components of the ink receiving layer, namely, the water-soluble resin and the inorganic fine particles, may be a single material, or a mixture of plural materials may be used for each main component.

Additionally, the water-soluble resin used in combination with the inorganic fine particles, and silica fine particles in particular, is important from the viewpoint of transparency retention. When the vapor-phase process silica is used, the water-soluble resin used in combination is preferably a polyvinyl alcohol resin, more preferably a polyvinyl alcohol resin having a saponification degree of from 70% to 100%, and particularly preferably a polyvinyl alcohol resin having a saponification degree of from 80% to 99.5%.

The polyvinyl alcohol resins have hydroxy groups in their respective structural units, and hydrogen bonds are formed between these hydroxy groups and silanol groups present on the surfaces of silica fine particles; as a result, it becomes easy to form a three-dimensional network structure having secondary particles of silica fine particles as network chain units. It is thought that the formation of such a three-dimensional network structure allows the ink receiving layer formed to have a porous structure with a high porosity and sufficient strength.

When inkjet recording is performed, the porous ink receiving layer formed in the foregoing manner can quickly absorb ink through capillary action and form dots of high circularity without generating ink bleeding.

The polyvinyl alcohol resin may be used in combination with other water-soluble resins. When another water-soluble resin is used in combination with the polyvinyl alcohol resin, the content of the polyvinyl alcohol resin is preferably 50% by mass or more, and more preferably 70% by mass or more with respect to the total mass of water-soluble resins used in the ink receiving layer.

Ratio of Inorganic Fine Particle Content to Water-soluble Resin Content:

By optimization of the ratio of the inorganic fine particle content (x) by mass to the water-soluble resin content (y) by mass [PB ratio (x/y)], the film structure and film strength of the ink receiving layer can further be enhanced.

In the invention, the PB ratio (x/y) in the ink receiving layer is preferably in a range of from 1.5 to 10 from the viewpoints of preventing a decrease in film strength and the appearance of cracks at drying, which are caused by excessively high PB ratios, and avoiding a reduction in ink absorbency by a porosity decrease resulting from a tendency to pores being clogged by the resins, which develops when PB ratios are excessively low.

Herein, it is especially preferred that the x/y ratio in the upper-side half of the ink receiving layer is equal to or higher than the x/y ratio in the lower-side half of the ink receiving layer (in other words, the upper-side half and the lower-side half have the same PB ratio, or the lower-side half is rich in binder), and a case in which the PB ratios in the upper-side half and the lower-side half are the same is preferable.

At the time of passage through the transport system of an inkjet printer, the recording medium is subjected to stress in some cases, so the ink receiving layer is preferable to have sufficient film strength. In addition, from the standpoint of avoiding the occurrence of cracking and exfoliation in the ink receiving layer when the recording medium is cut into sheets, the ink receiving layer is preferable to have sufficient film strength. In view of these cases, the mass ratio (x/y) is preferably 5 or less, while it is preferably 2 or more from the viewpoint of ensuring high-speed ink absorbency in inkjet printer.

For example, when a coating liquid prepared by completely dispersing vapor-phase process silica fine particles having an average primary particle diameter of 20 nm or less and a water-soluble resin at a mass ratio (x/y) of 2 to 5 is applied onto a substrate and dried, a three-dimensional network structure is formed having secondary particles of the silica fine particles as network chains, whereby a light-transmitting porous film having an average pore diameter of 30 nm or less, a porosity of 50% to 80%, a specific pore volume of 0.5 ml/g or more, and a specific surface area of 100 $m^2/g$ or more can be easily formed.

(Sulfur-Containing Compound)

From the viewpoints of further increasing color density and enhancing ozone resistance, it is preferable that the ink receiving layer in the invention contains at least sulfur-containing compound.

The sulfur-containing compound contained is preferably at least one sulfur-containing compound selected from the group consisting of thioether compounds, thiourea compounds, disulfide compounds, sulfinic acid compounds, thiocyanic acid compounds, sulfur-containing heterocyclic compounds, and sulfoxide compounds.

Thioether Compound

The thioether compound used for the foregoing purpose may be a water-soluble compound or an oil-soluble compound. In addition, the thioether compound may be low or high in molecular weight, but it is required to have at least one thioether group in the molecule.

The thioether compound has preferably 2 or more carbon atoms, and more preferably 4 or more carbon atoms.

In addition to sulfur, carbon and hydrogen atoms, it is preferable that the thioether compound used further contains an atom having a lone electron pair (such as an oxygen, sulfur, nitrogen or phosphorus atom).

Examples of such a thioether compound include compounds represented by the following Formula (1).

$$R_1—(S—R_3)_m—S—R_2 \quad (1)$$

In Formula (1), $R_1$ and $R_2$ each independently represent a hydrogen atom, a substituted or unsubstituted alkyl group, a substituted or unsubstituted aryl group, or an alkyl- or aryl-containing group. Alternatively, $R_1$ and $R_2$ may be the same or different, and may combine with each other to form a ring. However, at least one of $R_1$ or $R_2$ is required to be an alkyl group substituted by an hydrophilic group, such as a hydroxy group, a sulfo group, a carboxy group or a (poly)ethylene oxide group, or a basic nitrogen-containing group, such as an amino group, an amido group, an ammonium group, a nitrogen-containing heterocyclic group, an aminocarbonyl group or an aminosulfonyl group, or a group containing such a substituted alkyl group (for example, this substituted alkyl group may further bond to the thioether sulfur via a divalent linkage group, such as a carbamoyl group, a carbonyl group or a carbonyloxy group). $R_3$ represents an alkylene group which may be substituted and which, in some cases, may have an oxygen atom. m represents an integer of 0 to 10. When m is 1 or more, at least one sulfur atom bound to $R_3$ may be a sulfoxide group or a sulfonyl group. In addition, $R_1$ and $R_2$ each may be a polymer residue.

Among the compounds represented by Formula (1), the compounds each containing as at least one of $R_1$ or $R_2$, an alkyl group substituted by a hydroxy group, a carboxy group, an amino group or an ammonium group are especially preferred. Examples of the amino group by which the alkyl group is substituted include an amino group, an monoalkylamino group (the alkyl moiety of which is preferably an alkyl group having 1 to 5 carbon atoms) and a dialkylamino group (each alkyl moiety of which is preferably an alkyl group having 1 to 5 carbon atoms), and may further include a nitrogen-containing heterocyclic group. Examples of the compounds represented by Formula (1) are illustrated below, but the present invention is not limited thereto.

(1) $HO(CH_2)_3S(CH_2)_3OH$ (2) $CH_3SCH_2CH(NH_2)COOH$ (3) $HO(CH_2)_2S(CH_2)_2N(CH_3)_2$ (4) $HO(CH_2)_2S(CH_2)_2OH$ (5) $CH_3S(CH_2)_2CH(NH_2)COOH$ (6) $HO(CH_2)_2SCH_2S(CH_2)_2OH$ (7) $HO(CH_2)_2S(CH_2)_2S(CH_2)_2OH$ (8) $HO(CH_2)_2S(CH_2)_3S(CH_2)_2OH$ (9) $C_2H_5S(CH_2)_2SCH_2CHOHCH_2OH$

(10) $HOOCCH_2SCH_2SCH_2COOH$

(11) 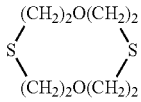

(12) $HO(CH_2)_2S(CH_2)_2SO_2(CH_2)_2S(CH_2)_2OH$

(13) $HO(CH_2)_3S(CH_2)_2S(CH_2)_3OH$

(14) $HOOCCH_2SCH_2COOH$

(15) $HOOCCH_2S(CH_2)_3SCH_2COOH$

(16) $HOOCCH_2S(CH_2)_2SCH_2COOH$

(17) $HO(CH_2)_2S(CH_2)_4S(CH_2)_2OH$

(18) $HO(CH_2)_2S(CH_2)_2S(CH_2)_2S(CH_2)_2OH$

(19) $HOOC(CH_2)_2S(CH_2)_2S(CH_2)_2COOH$

(20) $HOOC(CH_2)_2S(CH_2)S(CH_2)_2COOH$

(21) $(HO(CH_2)_2S(CH_2)_2)_2O$

(22) $H_2NCO(CH_2)_2S(CH_2)_2S(CH_2)_2CONH_2$

-continued

(23) $HOOC(CH_2)_2S(CH_2)_2COOH$

(24) $(HOCH_2CHOHCH_2SCH_2)_2$

(25) $HOOC(CH_2)_2S(CH_2)_3S(CH_2)_2COOH$

(26) $C_2H_5S(CH_2)_2S(CH_2)_2NHCO(CH_2)_2COOH$

(27) $HO(CH_2)_3S(CH_2)_2O(CH_2)_3O(CH_2)_2S(CH_2)_2OH$

(28) $HO(CH_2)_5S(CH_2)_6S(CH_2)_5OH$ (29)

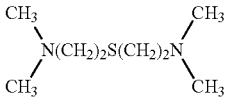

(30)

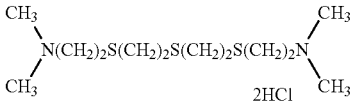

(31)

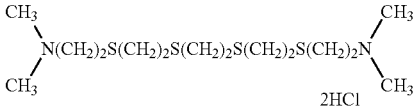

(32)

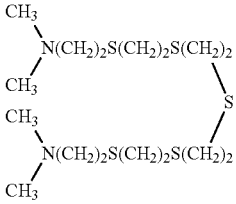

(33)

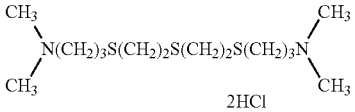

(34) $H_2N(CH_2)_3S(CH_2)_2S(CH_2)_2S(CH_2)_3NH_2$ 2HCl (35)

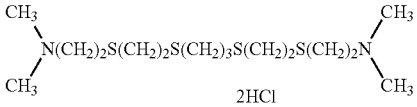

(36)

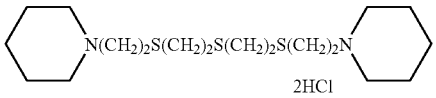

(37)

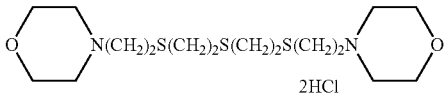

(38)

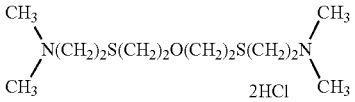

(39)

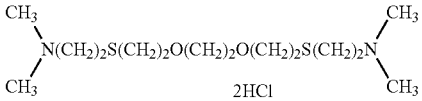

-continued (40)

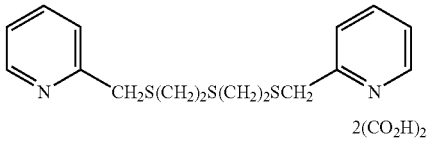

(41)

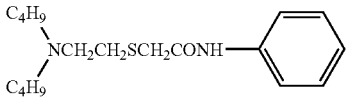

(42)

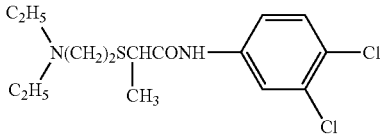

(43) $(CH_3)_3N^+(CH_2)_2S(CH_2)_2N^+(CH_3)_3 \cdot 2CH_3SO_3^-$

(44) $(CH_3)_3N^+(CH_2)_2S(CH_2)_2S(CH_2)_2N^+(CH_3)_3$

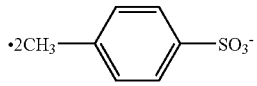

(45) $(C_2H_5)_2N^+(CH_2)_2S(CH_2)_2S(CH_2)_2N^+(C_2H_5)_2$ ($CH_3$ on each N)

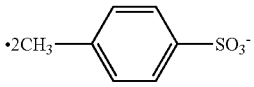

(46) $(CH_3)_3N^+(CH_2)_3S(CH_2)_2S(CH_2)_3N^+(CH_3)_3$

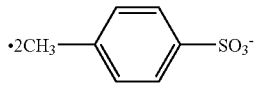

(47) $(CH_3)_3N^+(CH_2)_2S(CH_2)_2S(CH_2)_2S(CH_2)_2N^+(CH_3)_3$

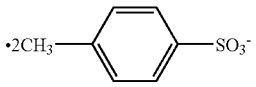

Thiourea Compound

The thiourea compound which can be used may be a water-soluble compound or an oil-soluble compound. In addition, the compound may be low or high in molecular weight, but it is required that the compound has at least one structural unit represented by >N—C(═S)—N< in the molecule.

Examples of such a thiourea compound include thiourea, N-methylthiourea, N-acetylthiourea, 1,3-diphenylthiourea, tetramethylthiourea, guanylthiourea, 4-methylthiosemicarbazide, 1,3-bis(hydroxymethyl)-2(3H)-benzimidazolethione, 6-hydroxy-1-phenyl-3,4-dihydropyrimidine-2(1H)-thione, 1-allyl-2-thiourea, 1,3-dimethyl-2-thiourea, 1,3-diethyl-2-thiourea, ethylenethiourea, trimethylthiourea, 1-carboxymethyl-2-thiohydantoin, and thiosemicarbazide.

Disulfide Compound

The disulfide compound may be a water-soluble compound or an oil-soluble compound. In addition, the compound may be low or high in molecular weight. The compounds represented by the following Formula (2), for example, are preferred. Among these compounds, DL-α-lipoic acid, 4,4'-dithiodimorpholine and 4,4'-dithiodibutanoic acid are especially preferable.

$R_1—S—S—R_2$ Formula (2)

In Formula (2), $R_1$ and $R_2$ each independently represent an organic group containing a carbon or nitrogen atom bound to the disulfide sulfur. This organic group may be a group forming a substituted or unsubstituted aliphatic group, a substituted or unsubstituted aromatic group, or a substituted or unsubstituted heterocyclic group in conjunction with the carbon or nitrogen atom bound to the disulfide sulfur, or an organic group which has on the carbon or nitrogen atom bound to the disulfide sulfur, a substituted or unsubstituted aliphatic, aromatic, heterocyclic or amino group or an imino group, an oxygen atom, a sulfur atom or so on. Alternatively, $R_1$ and $R_2$ may be the same or different, and may combine with each other to form a ring. Examples of a substituent which the group represented by $R_1$ and $R_2$ each may have include an alkyl group, an aryl group, a heterocyclic group, an amino group, an amido group, an imino group, an ammonium group, a hydroxy group, a sulfo group, a carboxy group, an aminocarbonyl group, an aminosulfonyl group and a halogen atom.

Sulfinic Acid Compound

The sulfinic acid compound may be a water-soluble compound or an oil-soluble compound. In addition, the compound may be low or high in molecular weight, and it is essential only that the compound has at least one sulfinic acid skeleton in the molecule.

The sulfinic acid compounds usable in the invention are preferably compounds represented by the following Formula (3).

$$R—SO_2M \qquad \text{Formula (3)}$$

In Formula (3), R represents a substituted or unsubstituted alkyl group (preferably having 6 to 30 carbon atoms), a substituted or unsubstituted aryl group (preferably having 6 to 30 carbon atoms, such as a phenyl group or a naphthyl group), or a polymer residue. M represents a hydrogen atom, an alkali metal atom or ammonium.

Examples of a substituent which the group represented by R may have include a linear, branched or cyclic alkyl group (preferably having 1 to 20 carbon atoms), an aralkyl group (which is preferably a mono- or di-cyclic group having a 1-3C alkyl moiety), an alkoxy group (preferably having 1 to 20 carbon atoms), a mono- or di-substituted amino group (a substituent or each substituent of which is preferably a 1-20C alkyl, acyl, alkylsulfonyl or arylsulfonyl group, provided that the total number of carbon atoms in the two substituents is 20 or less), a mono- to tri-substituted or unsubstituted ureido group (preferably having 1 to 20 carbon atoms), a substituted or unsubstituted aryl group (which is preferably a 6-29C mono- or di-cyclic aryl group), a substituted or unsubstituted arylthio group (preferably having 6 to 29 carbon atoms), a substituted or unsubstituted alkylthio group (preferably having 1 to 29 carbon atoms), a substituted or unsubstituted alkylsulfoxy group (preferably having 1 to 29 carbon atoms), a substituted or unsubstituted arylsulfoxy group (preferably having a 6-29C mono- or di-cyclic aryl moiety), a substituted or unsubstituted alkylsulfonyl group (preferably having 1 to 29 carbon atoms), a substituted or unsubstituted arylsulfonyl group (preferably having a 6-29C mono- or di-cyclic aryl moiety), an aryloxy group (preferably having a 6-29C mono- or di-cyclic aryl moiety), a carbamoyl group (preferably having 1 to 29 carbon atoms), a sulfamoyl group (preferably having 1 to 29 carbon atoms), a hydroxy group, a halogen atom (fluorine, chlorine, bromine or iodine), a sulfonic acid group and a carboxylic acid group.

Each of these substituents may further have another substituent, such as an alkyl group, an aryl group, an alkoxy group, an aryloxy group, an alkylthio group, an arylthio group, an alkylsulfonyl group, an arylsulfonyl group, a carbonamido group, a sulfonamido group, a carbamoyl group, a sulfamoyl group, an alkylsulfoxy group, an arylsulfoxy group, an ester group, a hydroxy group, a carboxy group, a sulfo group or a halogen atom. Some of these groups may combine with each other to form a ring, or may form a part of homopolymer or copolymer chain.

Examples of the sulfinic acid compound are illustrated below.

(A-1)

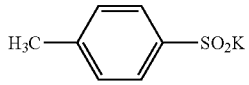

(A-2)

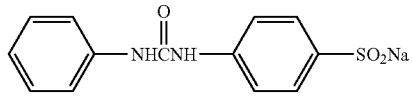

(A-3)

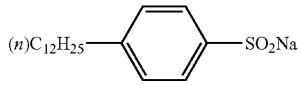

(A-4)

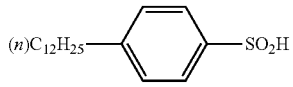

(A-5)

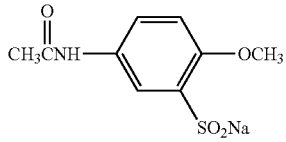

(A-6)

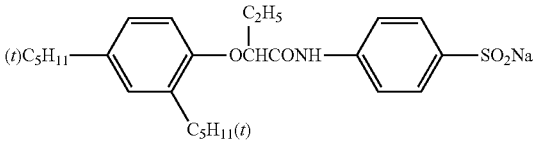

(A-7)

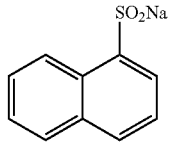

(A-8)

$(n)C_8H_{17}SO_2Na$ (A-9)

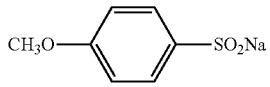

(A-10)

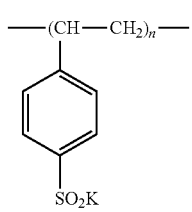

n = 6000

Thiocyanic Acid Compound Examples of a thiocyanic acid compound include methyl thiocyanate, ethyl thiocyanate, sodium thiocyanate, potassium thiocyanate and calcium thiocyanate.

Sulfur-Containing Heterocyclic Compound

Examples of a sulfur-containing heterocyclic compound include a compound containing a sulfur atom as a constituent atom of a heterocycle, a heterocycle-substituted mercapto compound, and a heterocycle-substituted mercapto compound in which the mercapto hydrogen is substituted by an alkyl group, an aryl group, an acyl group or a sulfonyl group. Among these compounds, the compounds represented by the following Formula (4) are preferred.

Formula (4)

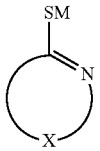

In Formula (4), X represents a group of nonmetal atoms necessary to form a 5- to 7-membered ring. This group of nonmetal atoms may have a substituent. Examples of the substituent include an alkyl group, an alkenyl group, an aryl group, an alkoxy group, an aryloxy group, an alkylthio group, an arylthio group, a hydroxy group, an amino group, a mercapto group, a carboxy group, an acyl group, a carbamoyl group, a sulfamoyl group, a halogen atom, and a cyano group. These substituents may further have a substituent.

M represents a hydrogen atom, an ammonium ion, or a metal atom. In addition, the group having a 5- to 7-membered ring formed in a state of containing X and another constituent may be fused together to form a condensed ring.

Examples of such heterocycle-substituted mercapto compounds include Compounds (1-1 to 1-32) described in JP-A No. 2000-94829, paragraphs [0027] to [0032].

Sulfoxide Compound:

The sulfoxide compound may be a water-soluble compound or an oil-soluble compound. In addition, the compound may be low or high in molecular weight, and it is essential only that the compound has at least one sulfoxide group in the molecule.

The sulfoxide compound has preferably 2 or more carbon atoms, and more preferably 4 or more carbon atoms.

In addition to a sulfoxide group, carbon atoms and hydrogen atoms, it is preferable that the sulfoxide compound further contains an atom having a lone electron pair (such as an oxygen, sulfur, nitrogen or phosphorus atom).

Examples of the sulfoxide compounds are illustrated below.

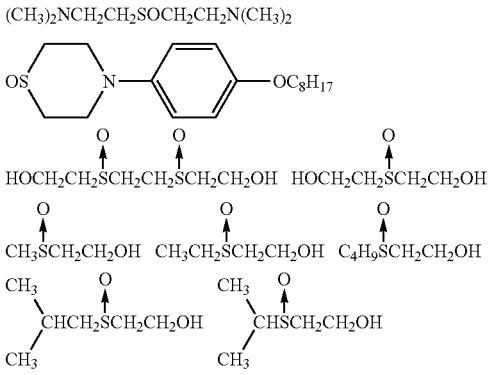

-continued

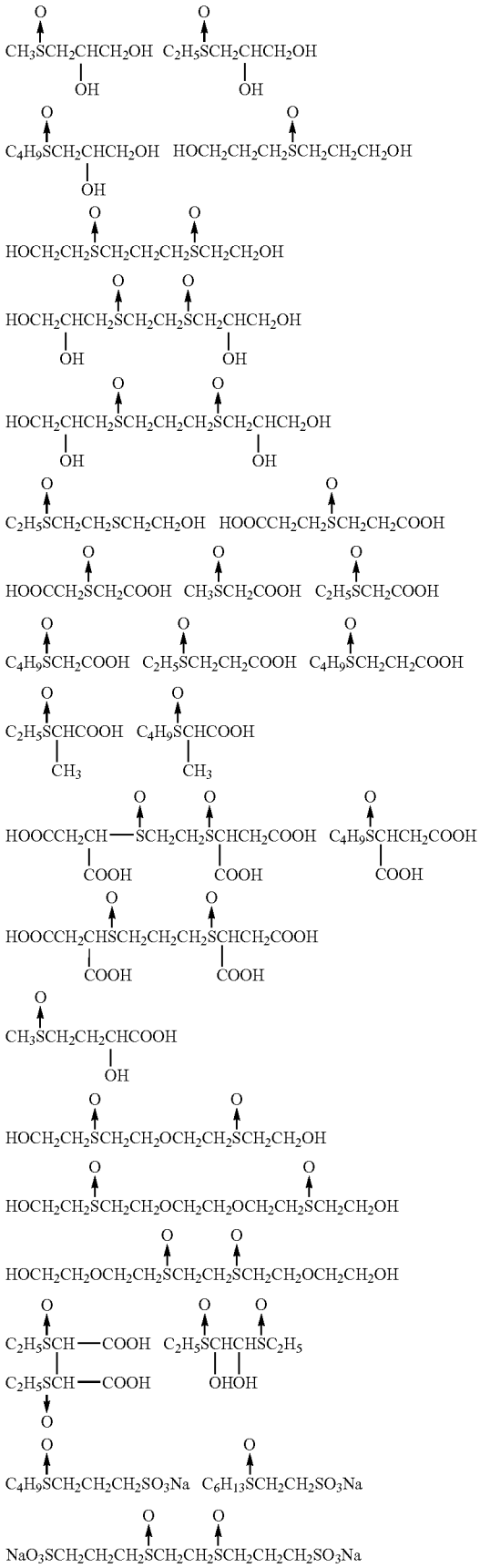

-continued
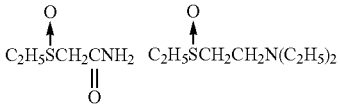
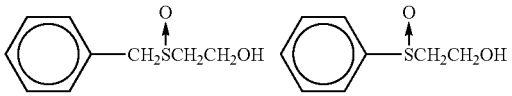
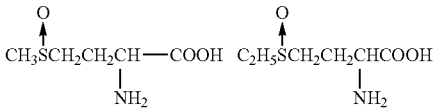
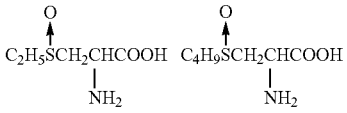
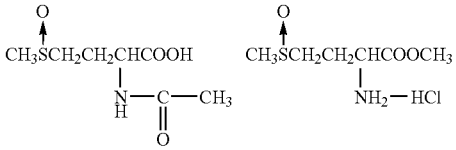
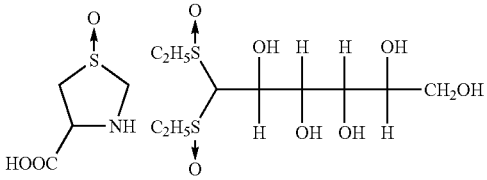
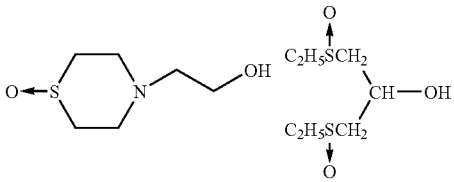
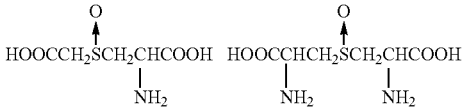
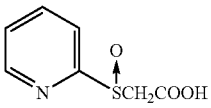
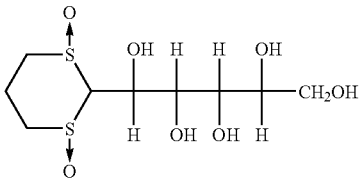
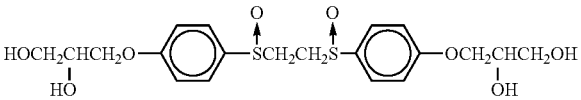
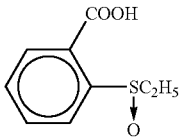
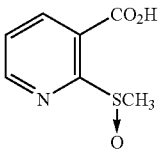
-continued
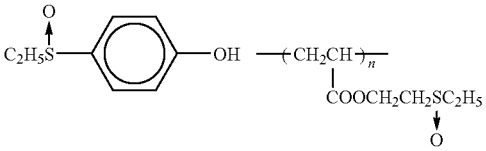
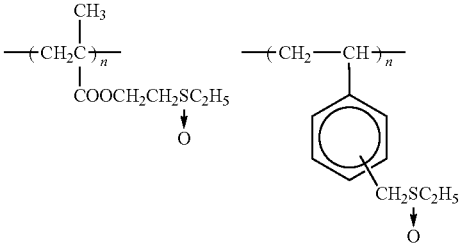
A-62)
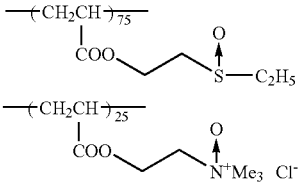
A-63)
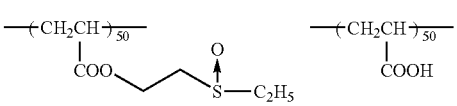
A-64)
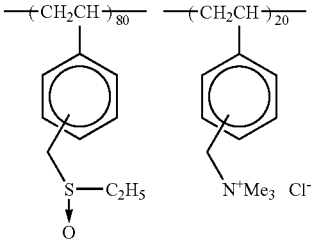
A-65)
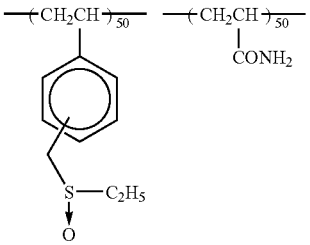
A-66)
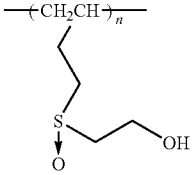
A-67)
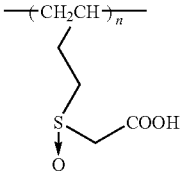

-continued

A-68)

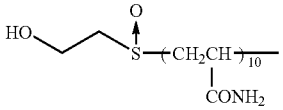

A-69)

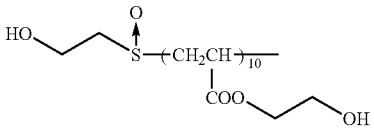

A-70)

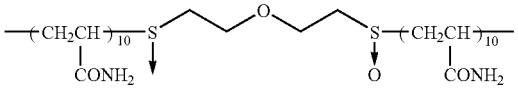

A-71)

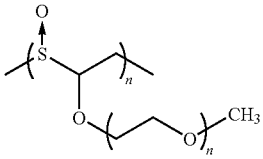

A-72)

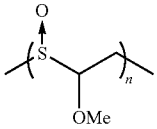

A-73)

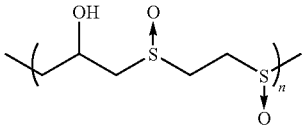

A-74)

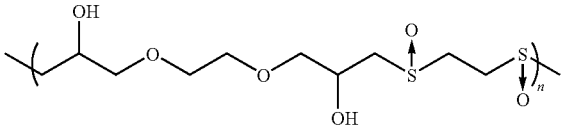

A-75)

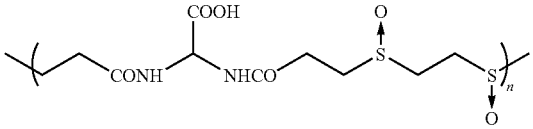

Examples of sulfur-containing compounds usable in the invention further include sulfone compounds, sulfonamide compounds, thioester compounds, thioamide compounds, sulfonic acid compounds, thiosulfonic acid compounds, thiosulfinic acid compounds, sulfamine compounds, thiocarbaminic acid compounds and sulfurous acid compounds.

Among the sulfur-containing compounds described above, thioether compounds or sulfoxide compounds are preferable from the viewpoints of ozone resistance and image density.

In this case, although the manner of incorporating the sulfur-containing compound into the ink receiving layer is not specifically limited, it is preferable that a content of the sulfur-containing compound in the first layer is higher than that in the second layer in the ink receiving layer in the case where the ink receiving layer includes the first ink receiving layer and the second ink receiving layer in this order from the substrate side, from the viewpoint of maintaining the density of the recorded image at a higher level.

Namely, the content ratio [the content in the second layer/the content in the first layer] of the sulfur-containing compound in the ink receiving layer is preferably less than 1.0, more preferably from 0 to 0.6, and specifically preferably 0 (namely, the second layer does not include the sulfur-containing compound). More preferably, the content ratio [the content in the second layer/the content in the first layer] of the sulfur-containing compound is from 0 to 0.6, and the content ratio [the content in the second layer/the content in the first layer] of the nitrogen-containing organic cationic polymer is from 0 to 0.8, from the viewpoints of image density and ozone resistance.

Furthermore, in the invention, it is preferable that the sulfur-containing compound in the ink receiving layer is a thioether compound or a sulfoxide compound, and the nitrogen-containing organic cationic polymer is at least one selected from a cationic urethane and a cationic polymer having a quaternary ammonium base, from the viewpoints of image density and bleeding.

More preferably, for the same reason as mentioned above, in the case where the sulfur-containing compound in the ink receiving layer is a thioether compound or a sulfoxide compound and the ink receiving layer has a first ink receiving layer and a second ink receiving layer in this order from the substrate side, the content ratio [the content in the second layer/the content in the first layer] of the sulfur-containing compound is from 0 to 0.6, the nitrogen-containing organic cationic polymer is at least one selected from a cationic urethane and a cationic polymer having a quaternary ammonium base, and the content ratio [the content in the second layer/the content in the first layer] of the nitrogen-containing organic cationic polymer is from 0 to 0.8.

In the invention, the existence distribution of the sulfur-containing compound in the ink receiving layer may be confirmed by an elemental analysis. Specifically, it is only necessary to perform a mapping analysis by SEM-EDX method and observe the obtained image. In this case, the existence position of the whole ink receiving layer is confirmed by a mapping analysis of the main component (e.g., Si element) of the ink receiving layer, a mapping analysis of S element is then performed, and which of the amount of the S element in the first layer and that of the second layer that is higher is determined from a mapping image.

Furthermore, the content of the sulfur-containing compound in the first layer in the case where the ink receiving layer includes the first layer and the second layer in this order from the substrate side is preferably from 1% by mass to 20% by mass, more preferably from 3% by mass to 15% by mass, and even more preferably from 4% by mass to 10% by mass, with respect to the total solids of the first layer, from the viewpoints of further improvement of the ozone resistance and retention of the image density at a higher level.

The content of the sulfur-containing compound in the second layer in the case where the ink receiving layer includes the first layer and the second layer in this order from the substrate side is preferably from 0% by mass to 5% by mass, more preferably from 0% by mass to 3% by mass, and specifically preferably 0% by mass (namely, the second layer does not include the sulfur-containing compound) with respect to the total solid content of the second layer, from the viewpoint of retention of a higher density of the recorded image.

Furthermore, the content of the sulfur-containing compound in the whole ink receiving layer including the second layer and the first layer where the ink receiving layer includes the first layer and the second layer in this order from the substrate side is preferably from 0.5% by mass to 5% by mass, more preferably from 1% by mass to 4% by mass, and specifically preferably from 1.5% by mass to 3% by mass, with respect to the total solids of the whole ink receiving layer, from the viewpoints of further improvement of the ozone resistance and retention of the image density at a higher level.

(Magnesium Salt)

From the viewpoint of further enhancing ozone resistance, it is preferable that the ink receiving layer in the invention further contains at least one magnesium salt.

Examples of the magnesium salt include magnesium acetate, magnesium oxalate, magnesium sulfate, magnesium chloride hexahydrate, and magnesium citrate nonahydrate. Among these salts, magnesium chloride hexahydrate is preferred.

Examples of a commercially available magnesium salt include WHITE NIGARI NS and ENKA MAG (TOKUGO) NS (trade names, manufactured by Naikai Salt Industries Co., Ltd.).

From the viewpoint of more effectively achieving effects of the invention, the content of the magnesium salt in the ink receiving layer is preferably from 0.05% by mass to 5% by mass, more preferably from 0.1% by mass to 3% by mass, and particularly preferably from 0.2% by mass to 2% by mass.

(Colloidal Silica)

When the ink recording medium in the invention has a colloidal silica layer as the outermost layer, the average primary particle diameter of colloidal silica used is preferably from 10 nm to 200 nm, and more preferably from 50 nm to 150 nm.

The colloidal silica is preferably anionic or nonionic. And anionic colloidal silica in particular is preferable. The content of the colloidal silica is preferably from 0.01 $g/m^2$ to 5 $g/m^2$, and particularly preferably from 0.05 $g/m^2$ to 2 $g/m^2$.

(Crosslinking Agent)

In view of crosslinking the water-soluble resin, it is preferable that the ink receiving layer in the invention contains at least one crosslinking agent.

Adoption of the ink receiving layer in a mode of porous layer formed by using the foregoing combination of inorganic fine particles and water-soluble resin in particular and hardening the porous layer by crosslinking reaction between the water-soluble resin and a crosslinking agent is one embodiment of the invention.

For crosslinking of the water-soluble resins, notably polyvinyl alcohol, boron compounds are suitably used.

Examples of the boron compounds include borax, boric acid, borates (such as orthoborate, $InBO_3$, $ScBO_3$, $YBO_3$, $LaBO_3$, $Mg_3(BO_3)_2$ and $CO_3(BO_3)_2$), diborates (such as $Mg_2B_2O_5$ and $CO_2B_2O_5$), metaborates (such as $LiBO_2$, $Ca(BO_2)_2$, $NaBO_2$ and $KBO_2$), tetraborates (such as $Na_2B_4O_7.10H_2O$), and pentaborates (such as $KB_5O_8.4H_2O$, $Ca_2B_6O_{11}.7H_2O$ and $CsB_5O_5$). Among these boron compounds, borax, boric acid and borates, especially boric acid, are preferably used in view of quick induction of crosslinking reaction.

As crosslinking agents for the water-soluble resins, the following compounds other than the boron compounds can also be used.

For example, the compounds usable as the crosslinking agents include aldehyde compounds, such as formaldehyde, glyoxal and gurtaraldehyde; ketone compounds, such as diacetyl and cyclopentanedione; active halogen compounds, such as bis(2-chloroethyl)urea, 2-hydroxy-4,6-dichloro-1,3,5-triazine and sodium 2,4-dichloro-6-s-triazine; active vinyl compounds, such as divinylsulfonic acid, 1,3-bis(vinylsulfonyl)-2-propanol, N,N'-ethylenebis(vinylsulfonylacetamide) and 1,3,5-triacryloyl-hexahydro-s-triazine; N-methylol compounds, such as dimethylolurea and methyloldimethylhydantoin; melamine resins, such as methylolmelamine and alkylated methylolmelamine; epoxy resins; isocyanate compounds, such as 1,6-hexamethylene diisocyanate; the aziridine compounds described in U.S. Pat. Nos. 3,017,280 and 2,983,611; the carboxyimide compounds described in U.S. Pat. No. 3,100,704; epoxy compounds, such as glycerol triglycidyl ether; ethyleneimino compounds, such as 1,6-hexamethylene-N,N'-bisethyleneurea; halogenated carboxyaldehyde compounds, such as mucochloric acid and mucophenoxychloric acid; dioxane compounds, such as 2,3-dihydroxydioxane; metal-containing compounds, such as titanium lactate, aluminum sulfate, chrome alum, potassium alum, zirconyl acetate and chromium acetate; polyamine compounds, such as tetraethylenepentamine; hydrazide compounds, such as adipic dihydrazide; and low-molecular compounds and polymers each having at least two oxazoline groups.

The crosslinking agents described above can be used alone or in a combination of any two or more of them.

The amount of crosslinking agent(s) used is preferably from 1% by mass to 50% by mass, and more preferably from 5% by mass to 40% by mass, based on the water-soluble resin.

(Other Ingredients)

In addition to the nitrogen-containing organic cationic polymer, the magnesium salt and the water soluble polyvalent metal salt described above, the ink receiving layer in the invention may contain a mordant, various surfactants and other ingredients.

As the other ingredients, those chosen appropriately from the ingredients described in JP-A No. 2005-14593, paragraphs [0088] to [0117], and JP-A No. 2006-321176, paragraphs [0138] to [0155], can be used.

<Substrate>

As the substrate in the invention, both a transparent substrate made from a transparent material such as plastic and an opaque substrate made from an opaque material such as paper can be used. In order to capitalize on the transparency of the ink receiving layer, it is preferable to use a transparent substrate or a high-gloss opaque substrate.

A transparent material resistant to radiant heat applied thereto when the medium is used on an OHP or back light display is preferable as the material for the transparent substrate. Examples of the material include polyesters such as polyethylene terephthalate (PET), polysulfone, polyphenylene oxide, polyimide, polycarbonate, polyamide and the like. Among them, polyesters are preferable, and polyethylene terephthalate is particularly preferable.

The thickness of the transparent substrate has no particular limits, but it is preferably from 50 μm to 200 μm in view of easy handling.

The high-gloss opaque substrate preferably has a glossiness of 40% or more on the surface where the ink receiving layer is formed. The glossiness is a value determined by a known method taught by ISO 8254-1, i.e., Paper and board—Measurement of specular gloss—Part 1:75 degree gloss with a converging beam. Specific examples of the substrates include the following.

Specific examples of the high-gloss opaque substrate include: high-gloss paper substrates such as art paper, coated paper, cast-coated paper, baryta paper commonly used as a silver salt photographic substrate and the like; high-gloss films opacified by adding a white pigment or the like to any one of plastic films such as polyesters such as polyethylene terephthalate (PET), nitrocellulose, cellulose esters such as cellulose acetate, and cellulose acetate butyrate, polysulfone, polyphenylene oxide, polyimide, polycarbonate, polyamide or the like (which may be additionally surface calendered); substrates having a polyolefin coating layer containing or not containing a white pigment formed on the surface of these various paper, the transparent substrates, or the high-gloss films containing a white pigment; or the like.

Foamed polyester films containing a white pigment (e.g., a foamed polyester formed by expanding a polyolefin fine particle-containing PET film so as to forming voids therein) are favorable and also included as examples. In addition, resin coated papers commonly used as photographic papers for silver salt photographs are also preferable.

While the thickness of the opaque substrate is not particularly limited, it is preferably in a range of 50 μm to 300 μm from the viewpoint of ease of handling.

The surface of substrate may be subjected to corona discharge treatment, glow discharge treatment, flame treatment, ultraviolet ray irradiation treatment or the like for improvement in wetting property and adhesive property.

Then, base paper used in the resin coated papers is described in detail.

The base paper is made from wood pulp as a principal material and, if needed, synthetic pulp made from, e.g., polypropylene, or synthetic fiber, such as nylon fiber or polyester fiber, as an additional material. As the wood pulp, any of LBKP, LBSP, NBKP, NBSP, LDP, NDP, LUKP and NUKP can be used. It is preferable to use wood pulp with a high content of short fibers, such as LBKP, NBSP, LBSP, NDP or LDP.

However, the proportion of LBSP and/or LDP is preferably from 10% by mass to 70% by mass.

Chemical pulps (such as sulfate salt pulp or sulfite pulp) containing a smaller amount of impurities are preferably used as the pulp used in the invention. Bleached pulps which are improved in whiteness are also useful.

Various additives including a sizing agent such as higher fatty acid or alkylketene dimer, a white pigment such as calcium carbonate, talc or titanium oxide, a paper-strength enhancing additive such as starch, polyacrylamide or polyvinyl alcohol, a fluorescent whitening agent, a moisturizing agent such as polyethylene glycols, a dispersant, a softener such as quaternary ammonium, and the like may be added to the base paper in accordance with necessity.

The freeness of the pulp for use in sheeting is preferably 200 mL to 500 mL as per CSF (Canadian Standard Freeness) regulations. In regard to the fiber length after beating, the total amount of pulps remaining on 24- and 42-mesh screens is preferably 30% to 70% by mass, as determined by the known method taught by ISO 534, i.e., Paper and board—Determination of thickness and density. Further, the amount of the pulp remaining on 4-mesh screen is preferably 20% by mass or less.

The basis weight of base paper is preferably from 30 $g/m^2$ to 250 $g/m^2$, particularly preferably from 50 $g/m^2$ to 200 $g/m^2$. The thickness of base paper is preferably from 40 μm to 250 μm. It is also possible to impart high smoothness to base paper by performing calender treatment during a papermaking stage or after the papermaking has finished. The base paper density is generally from 0.7 $g/m^3$ to 1.2 $g/m^3$ (JIS P-8118). Furthermore, the stiffness of base paper is preferably from 20 g to 200 g under conditions defined by JIS P-8143.

The base paper surface may be coated with a surface sizing agent, and a similar sizing agent as added for internal sizing of base paper can also be used as the surface sizing agent.

The pH of base paper is preferably from 5 to 9 as measured according to the hydrothermal extraction method defined by JIS P-8113.

The polyethylene covering the front and rear surfaces of the base paper is mainly a low-density polyethylene (LDPE) and/or a high-density polyethylene (HDPE), but other LLDPE, polypropylene, or the like may also be used partially.

In particular, the polyethylene layer at the side on which the ink receiving layer is provided is preferably formed of polyethylenes containing rutile-titanium oxide, anatase-titanium oxide, a fluorescent whitening agent, and/or ultramarine that are improved in opacity, whiteness and hue, which are commonly used in photographic papers. The content of the titanium oxide is preferably in a range of from about 3% by mass to about 20% by mass and more preferably in a range of from 4% by mass to 13% by mass, with respect to the polyethylene. The thickness of the polyethylene layer, either front or rear, is not particularly limited, but is favorably in a range of from 10 μm to 50 μm. In addition, an undercoat layer may be formed on the polyethylene layer for increasing the adhesion thereof to an ink receiving layer. Water dispersible polyester, gelatin, and PVA are preferable for the undercoat layer. The thickness of the undercoat layer is preferably in a range of from 0.01 μm to 5 μm.

The polyethylene-coated paper may be used as a glossy paper.

The polyethylene layer coated on the surface of the base paper by melt-extrusion may be further subjected to a surface modification treatment such as embossing so that it has a mat or silky surface similar to that of common photographic printing papers.

The substrate can be provided with a backcoat layer. To the backcoating layer, white pigment, an aqueous binder and other ingredients can be added.

Examples of the white pigment which can be incorporated into the backcoat layer include inorganic white pigments, such as precipitated calcium carbonate, ground calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo boehmite, aluminum hydroxide, alumina, lithopone, zeolite, hydrous halloysite, magnesium carbonate and magnesium hydroxide; and organic pigments, such as styrene-base plastic pigment, acrylic plastic pigment, polyethylene, microcapsules, urea resin and melamine resin.

Examples of the aqueous binders for use in the backcoat layer include water-soluble polymers such as copolymers of styrene/maleic acid salt, copolymers of styrene/acrylic acid salt, polyvinyl alcohol, silanol-modified polyvinyl alcohols, starch, cationic starch, casein, gelatin, carboxymethyl cellulose, hydroxyethyl cellulose, or polyvinylpyrrolidone; water-dispersible polymers such as styrene butadiene latexes or acryl emulsions; and the like.

The other components contained in the backcoat layer include a defoaming agent, antifoaming agent, dye, fluorescent whitening agent, antiseptic, water-resistance imparting agent, and the like.

<Others>

In addition to the ink receiving layer, the present inkjet recording medium may further have an ink-solvent absorption layer, an intermediate layer and a protective layer. Furthermore, an undercoat layer may also be provided on the substrate for the purposes of enhancing adhesion between the substrate and the ink receiving layer and adjusting the electric resistance as appropriate.

To constituent layers (e.g., the ink receiving layer and the backcoat layer) of the present inkjet recording medium, a polymer fine-particle dispersion may be added. This polymer fine-particle dispersion is used for the purpose of improving film physical properties, such as film's dimensional stability and anti-curling, anti-sticking and anti-cracking properties. Descriptions of the polymer fine-particle dispersion can be found, e.g., in JP-A Nos. 62-245258 and 10-228076 each. Additionally, when a dispersion of polymer fine particles with a low glass transition temperature (40° C. or lower) is added to the layer containing a mordant described above, the layer can be prevented from cracking and curling. Alternatively, curling can be prevented also by adding a dispersion of polymer fine particles with a high glass transition temperature to the backing layer.

Additionally, the ink receiving layer, though may be provided on only one side of the substrate, may also be provided on both sides of the substrate. When the ink receiving layer is provided on only one side of the substrate for a recording medium used in OHP or the like, an antireflection layer can also be provided on the opposite side or either side of the substrate for the purpose of enhancing light-transmitting property.

Further, by applying boric acid or a boron compound to the substrate surface on the side where the ink receiving layer is to be provided, and thereon forming the first ink receiving layer and the second ink receiving layer in this order from the substrate side, it also becomes possible to ensure glossiness and surface smoothness of the ink receiving layer and inhibit printed-image bleeding over time in high-temperature and high-humidity environments.

The inkjet recording medium of the invention may be prepared by providing a process of forming a coating layer by coating a coating solution including inorganic fine particles and a water-soluble metal compound.

Alternatively, when the ink receiving layer includes the first layer and the second layer in this order from the substrate side as a ink receiving layer, the inkjet recording medium may be prepared by the following first or second method.

The First Exemplary Embodiment

The first exemplary embodiment of the method for the production of the inkjet recording medium is an exemplary embodiment including a process of forming coating layers by multilayer coating of a first coating solution including at least inorganic fine particles and a nitrogen-containing organic cationic polymer, and a second coating solution including inorganic fine particles and a water-soluble aluminum compound on a substrate in this order from the substrate side, and a process of hardening the coating layers by crosslinking by adding a solution including a basic compound to the formed coating layers (1) at the same time as the coating of at least the first coating solution and the second coating solution, or (2) during drying of the coating layers formed by coating at least the first coating solution and the second coating solution, and prior to the falling-rate drying of the coating layer, to form an ink receiving layer having a laminate structure of two or more layers in which the coating layers are formed by crosslinking the coating layers, the content of the nitrogen-containing organic cationic polymer in the first ink receiving layer is higher, that is on the side closer to the substrate, is higher than that in the second ink receiving layer that is on the side farther from the substrate, and the content of the water-soluble aluminum compound in the second ink receiving layer that is on the side farther from the substrate, is higher than that in the first ink receiving layer that is on the side closer to the substrate.

The Second Exemplary Embodiment

The second exemplary embodiment of the method for the production of the inkjet recording medium is an exemplary embodiment including a process of forming coating layers by multilayer coating of a first coating solution including at least inorganic fine particles and a nitrogen-containing organic cationic polymer, and a second coating solution including inorganic fine particles and a water-soluble aluminum compound on a substrate in this order from the substrate side, a process of cooling the formed coating layers so that the temperature of the coating layers is decreased by 5° C. or more from the temperature of the first coating solution at the time of the coating or the temperature of the second coating solution at the time of the coating, whichever is lower, and a process of drying the cooled coating layers, to form an ink receiving layer having a laminate structure of two or more layers in which the content of the nitrogen-containing organic cationic polymer in the first ink receiving layer, that is on the side closer to the substrate, is higher than that in the second ink receiving layer that is on the side farther from the substrate, and the content of the water-soluble aluminum compound in the second ink receiving layer that is on the side farther from the substrate, is higher than that in the first ink receiving layer that is on the side closer to the substrate.

By preparing the inkjet recording medium of the invention according to the first or second exemplary embodiment, the inkjet recording medium may be formed so that the content of the nitrogen-containing organic cationic polymer in the first ink receiving layer, that is on the side closer to the substrate, is higher than that in the second ink receiving layer that is on the side farther from the substrate. Accordingly, the color change that occurs from immediately after recording may be prevented, the bleeding of the recorded image over time may be suppressed, and a high image density may be maintained. Furthermore, the inkjet recording medium is excellent in ozone resistance, and the state of the surface is further improved.

In the first and second exemplary embodiments, a process of forming coating layers by multilayer coating of the first coating solution including at least inorganic fine particles and the nitrogen-containing organic cationic polymer, and a second coating solution including inorganic fine particles and the water-soluble aluminum compound on the substrate (preferably at the coating solution temperature of from 35° C. to 45° C.) in this order from the substrate side (hereinafter sometimes referred to as "coating layer forming process") is provided.

In the coating layer forming process, other coating solution may further be applied on the second coating solution when necessary. Moreover, a barrier layer coating solution (intermediate layer coating solution) may intervene in the coating solutions.

The first coating solution and the second coating solution (and besides, the other coating solution as required) have no particular restriction as to the mode of their applications. In other words, these solutions may be formed into the coating layer in accordance with a simultaneous multilayer coating method hitherto known, or they may be formed into the coating layer on a one-by-one basis (by sequential coating) in accordance with a heretofore-known method.

The simultaneous multilayer coating can be performed with known coating apparatus, such as an extrusion die coater and a curtain flow coater.

And the sequential coating can be performed with known coating apparatus, such as an extrusion die coater, an air doctor coater, a blade coater, a rod coater, a knife coater, a squeeze coater, a reverse roll coater and a bar coater.

Herein, the suitable coating amount of each coating solution is described.

The coating amount of the first coating solution on a wet basis is preferably from 50 mL/m$^2$ to 200 mL/m$^2$, and more preferably from 75 mL/m$^2$ to 150 mL/m$^2$, while the coating amount of the first coating solution on a solids basis is preferably from 5 g/m$^2$ to 25 g/m$^2$, and more preferably from 10 g/m$^2$ to 18 g/m$^2$.

The coating amount of the second coating solution on a wet basis is preferably from 50 mL/m$^2$ to 200 mL/m$^2$, and more preferably from 75 mL/m$^2$ to 150 mL/m$^2$, while the coating amount of the second coating solution on a solids basis is preferably from 5 g/m$^2$ to 25 g/m$^2$, and more preferably from 10 g/m$^2$ to 18 g/m$^2$.

When the other coating solution, for example, a coating solution containing colloidal silica is used, the coating amount of the other coating solution on a wet basis is preferably from 10 mL/m$^2$ to 150 mL/m$^2$, and more preferably from 20 mL/m$^2$ to 100 mL/m$^2$, while the coating amount of the other coating solution on solids basis is preferably from 0.01 g/m$^2$ to 10 g/m$^2$, and more preferably from 0.05 g/m$^2$ to 5 g/m$^2$.

The first coating solution, the second coating solution, and the other coating solution used as required are described below.

(First Coating Solution)

The first coating solution includes at least one type of inorganic fine particles and at least one nitrogen-containing organic cationic polymer. Specifics for the inorganic fine particles in the first coating solution are as already mentioned for the inorganic fine particles in the ink receiving layer. Although the content of the inorganic fine particles in the first coating solution is not specifically limited, it is preferably from 50% by mass to 90% by mass, and more preferably from 60% by mass to 80% by mass, with respect to the total solids of the first coating solution.

In the invention, the total solids in the first coating solution refers to all components except water in the first coating solution. The same applies to the other solutions.

The nitrogen-containing organic cationic polymer included in the first coating solution is preferably at least one selected from a cationic polyurethane and a cationic polymer having a quaternary ammonium base, and more preferably a cationic polyurethane, from the viewpoint of suppression of generation of bleeding. Furthermore, the nitrogen-containing organic cationic polymer is preferably included in the first coating solution in the form of an aqueous emulsion, and more preferably included in the form of an aqueous emulsion of a cationic polyurethane Furthermore, the first coating solution further includes, preferably a nitrogen-containing organic cationic polymer other than the cationic polyurethane, and more preferably at least one selected from polydiallyldimethylammonium chloride and a polymethacryloyloxyethyl β-hydroxyethyldimethylammonium chloride derivative, and even more preferably polydiallyldimethylammonium chloride, from the viewpoint of the dispersing property of the inorganic fine particles.

The content of the nitrogen-containing organic cationic polymer in the first coating solution is preferably from 1% by mass to 20% by mass, more preferably from 2% by mass to 15% by mass, and specifically preferably from 4% by mass to 12% by mass, with respect to the total solids of the first coating solution.

It is preferable that the first coating solution further includes a sulfur-containing compound from the viewpoint of further improvement of ozone resistance. In this case, the content of the sulfur-containing compound in the first coating solution is preferably from 1% by mass to 20% by mass, more preferably from 3% by mass to 15% by mass, and specifically preferably from 4% by mass to 10% by mass with respect to the total solids of the first coating solution, from the viewpoint of obtaining the effect of the invention more effectively.

Furthermore, the first coating solution may further include a water-soluble resin, a crosslinking agent, a water-soluble polyvalent metal salt, a mordant, a dispersant, a surfactant and the like, besides the essential components. In the coating of the first coating solution, it is also preferable that the first coating solution is subjected to in-line mixing with a solution including the above-mentioned water-soluble polyvalent metal salt (preferably basic polyaluminum chloride), followed by coating.

The specifics for the components including the sulfur-containing compound, water-soluble resin, crosslinking agent, mordant, water-soluble polyvalent metal salt and the like are as already mentioned in the above-mentioned section of <Ink receiving layer>, and the preferable exemplary embodiments are also similar. The dispersion agent is mentioned below.

The first coating solution is preferably acidic, and has a pH of preferably 5.0 or less, more preferably 4.5 or less, and further preferably 4.0 or less. The pH of the first coating solution may be adjusted by suitably selecting the cationic polymer and the amount thereof to be added. Furthermore, the pH may be adjusted by adding an organic or inorganic acid. When the first coating solution has a pH of 5.0 or less, the crosslinking reaction of the water-soluble resin with the crosslinking agent (specifically a boron compound) in the first coating solution may be suppressed more sufficiently.

Preparation Method of First Coating Solution

The first coating solution containing at least inorganic fine particles and a nitrogen-containing organic cationic polymer can be prepared, e.g., as follows.

Specifically, inorganic fine particles (which are preferably vapor-phase process silica fine particles) and a dispersant are added to water (so that the inorganic fine particles added have a content of, e.g., 10% by mass to 20% by mass in water), subjected to a dispersing operation using a rapidly rotating wet colloidal mill (e.g., CLEARMIX, trade name, made by M TECHNIQUE) under conditions that the dispersion time is, e.g., 20 minutes (preferably from 10 minutes to 30 minutes) and the revs are, e.g., as high as 10,000 rpm (preferably from 5,000 rpm to 20,000 rpm). To the resulting dispersion, a crosslinking agent (e.g., boric acid), an aqueous polyvinyl alcohol (PVA) solution (in such an amount that the PVA content becomes about one-third of the inorganic fine particles content) and a nitrogen-containing organic cationic polymer are added, and further the water-soluble polyvalent metal salt (e.g., basic polyaluminum hydroxide) is added, and then subjected to the dispersion operation under the same rotational conditions as mentioned above, thereby preparing the first coating solution.

The water-soluble polyvalent metal salt may be added by in-line mixing just before application.

As an alternative machine for the dispersing operations, a liquid-liquid collision dispersing machine (e.g., ULTIMIZER, trade name, made by Sugino Machine Ltd.) can also be used.

The coating solution obtained is in a homogeneous sol state, and this solution is applied onto a substrate in accordance with the following application method, and then dried. Thus, a porous ink receiving layer having a three-dimensional network structure can be formed.

The aqueous dispersion containing the inorganic fine particles (preferably vapor-phase process silica) and the dispersant may be prepared by preparing in advance an aqueous dispersion of the inorganic fine particles and then adding the aqueous dispersion of the inorganic fine particles to an aqueous dispersant solution or adding an aqueous dispersant solution to the aqueous dispersion of the inorganic fine particles, or mixing them simultaneously. Alternatively, powder of the inorganic fine particles, not the aqueous dispersion of the inorganic fine particles, may be directly added to the aqueous dispersant solution.

After mixing the inorganic fine particles and the dispersant, the resulting mixture is subjected to fining of particles by use of a dispersing machine, and thereby an aqueous dispersion including fine particles having an average particle size of from 50 nm to 300 nm can be obtained. Examples of a dispersing machine usable for obtaining such an aqueous dispersion include various dispersing machines hitherto known, such as a rapidly rotating dispersing machine, a medium agitation-type dispersing machine (such as a ball mill or a sand mill), a ultrasonic dispersing machine, a colloid mill dispersing machine and a high-pressure dispersing machine. Among these dispersing machines, an agitation-type dispersing machine, a colloid mill dispersing machine and a high-pressure dispersing machine are preferred from the viewpoint of effectively dispersing clotted fine grains.

In each of the foregoing steps, water, an organic solvent or a mixture thereof can be used as a solvent. Examples of an organic solvent usable in the application include alcohols such as methanol, ethanol, n-propanol, isopropanol and methoxypropanol, ketones such as acetone and methyl ethyl ketone, tetrahydrofuran, acetonitrile, ethyl acetate and toluene.

As the dispersant used in the foregoing preparation, a cationic polymer may be used. Examples of the cationic polymer include the mordants described in JP-A No. 2006-321176, paragraphs [0138] to [0148]. Alternatively, the use of a silane coupling agent as the dispersant is also preferable.

The amount of the dispersant added is preferably from 0.1% to 30%, and more preferably from 1% to 10%, with respect to the fine particles.

(Second Coating Solution)

The second coating solution includes at least one type of inorganic fine particles and at least one water-soluble aluminum compound. The specifics of the inorganic fine particles in the second coating solution are as already mentioned above for the inorganic fine particles in the ink receiving layer. Although the content of the inorganic fine particles in the second coating solution is not specifically limited, it is preferably from 50% by mass to 85% by mass, and more preferably from 55% by mass to 70% by mass, with respect to the total solids of the second coating solution.

The water-soluble aluminum compound included in the second coating solution is as already mentioned above for the water-soluble aluminum compound in the ink receiving layer. Although the content of the water-soluble aluminum compound in the second coating solution is not specifically limited, it is preferably from 0.1% by mass to 10% by mass, and more preferably from 0.5% by mass to 8% by mass with respect to the inorganic fine particles, from the viewpoint of ozone resistance.

The second coating solution may include a nitrogen-containing organic cationic polymer to the extent that the effect of the invention is not deteriorated. It is preferable that the content of the nitrogen-containing organic cationic polymer in the second coating solution is lower than the content of the nitrogen-containing organic cationic polymer in the first coating solution, from the viewpoint that the content of the nitrogen-containing organic cationic polymer in the ink receiving layer, that is closer to the substrate, is to be higher than that in the ink receiving layer that is farther from the substrate. Namely, it is necessary that the content ratio [content in the second coating solution/content in the first coating solution] of the nitrogen-containing organic cationic polymer is less than 1.0.

Furthermore, when the second coating solution in the invention includes at least one selected from a cationic polyurethane and a cationic polymer having a quaternary ammonium base (hereinafter sometimes referred to as "specific nitrogen-containing organic cationic polymer") as the nitrogen-containing organic cationic polymer, the content ratio thereof is preferably from 0 to 0.7, and more preferably from 0 to 0.4, specifically preferably 0 (namely, an exemplary embodiment where the second coating solution does not include the specific nitrogen-containing organic cationic polymer), from the viewpoint of obtaining the effect of the invention more effectively.

In view of further efficient attainment of the effects of the invention, the content of the nitrogen-containing organic cationic polymer in the second coating solution is preferably from 0% by mass to 8% by mass, more preferably from 0% by mass to 4% by mass, and particularly preferably 0% by mass (which indicate a state in which the second coating solution contains no nitrogen-containing organic cationic polymers), with respect to the total solids in the second coating solution.

In addition, the second coating solution may contain a sulfur-containing compound, but from the viewpoint of keeping the densities of recorded images higher, the content of the sulfur-containing compound in the second coating solution is preferably made lower than that in the first coating solution.

In other words, it is required that the content ratio of the sulfur-containing compound [content in the second coating solution/content in the first coating solution] be lower than 1.0.

In this case, the content ratio of the sulfur-containing compound [content in the second coating solution/content in the first coating solution] is preferably from 0 to 0.6, more preferably from 0 to 0.3, and particularly preferably 0 (which indicates a state in which the second coating solution contains no sulfur-containing compound).

In view of further efficient attainment of the effects of the invention, the content of the sulfur-containing compound content in the second coating solution is preferably from 0% by mass to 5% by mass, more preferably from 0% by mass to 3% by mass, and particularly preferably 0% by mass (which indicate a state in which the second coating solution contains no sulfur-containing compound), with respect to the total solids in the second coating solution.

Moreover, the second coating solution may contain, a water-soluble resin, a dispersant, a crosslinking agent, a water soluble polyvalent metal salt, a mordant, a surfactant, and other ingredients.

When the second coating solution is applied, it is also preferable that the second coating solution is subjected to in-line mixing with a solution containing the water-soluble polyvalent metal salt described above (preferably a basic polyaluminum chloride), and then applied.

Details of various ingredients including the sulfur-containing compound, the water-soluble resin, the mordant, the surfactant and the water-soluble polyvalent metal salt are the same as described in the section <Ink receiving layer>, and preferred embodiments are also similar to those specified in that section. Details of the dispersant are the same as mentioned in the description of the first coating solution, and a preferred range of the dispersant is also similar.

In addition, the second coating solution can be prepared in a manner substantially similar to that of the first coating solution.

The second coating solution is preferably acidic similarly to the first coating solution, and the pH thereof is preferably 5.0 or lower, more preferably 4.5 or lower, and further preferably 4.0 or lower. The pH adjustment to such a range can be made by appropriately choosing the cationic polymer resin or addition amount thereof. Alternatively, the adjustment may be made by addition of an organic or inorganic acid. When the pH of the second coating solution is 5.0 or lower, crosslinking reaction of the water-soluble resin with a crosslinking agent (a boron compound in particular) in the second coating solution can be inhibited satisfactorily.

(Other Coating Solution)

The other coating solution, which is used as required, is described below.

The other coating solution preferably contains colloidal silica. By further applying the other coating solution containing colloidal silica onto the second coating solution, the colloidal silica layer can be formed as the outermost layer of the ink receiving layer. As a result, the glossiness of the ink receiving layer formed can be enhanced.

The colloidal silica is the same as described in the foregoing section <Ink receiving layer>, and the preferred range thereof is also similar.

The other coating solution can be prepared, for example, by adding colloidal silica to ion exchange water, and mixing them with stirring.

<Hardening Process>

The first exemplary embodiment has a process of performing cross-link hardening of the coating layer formed in the coating-layer formation process by application of a basic compound-containing solution at either (1) the same time as at least the first coating solution and the second coating solution are applied or (2) a stage in the course of drying of the coating layers formed by applying at least the first coating solution and the second coating solution, and that before the coating layer shows falling-rate drying. Hereafter, this process is referred to as the hardening process too.

As a method of applying the basic compound-containing solution "(1) at the same time as at least the first coating solution and the second coating solution are applied", the mode of simultaneous coating (simultaneous multilayer coating) in which the first coating solution, the second coating solution, the other coating solution as required, and the basic compound-containing solution are applied simultaneously in this order from the substrate side, is suitable. Alternatively, it may adopt a mode that the first coating solution is applied, and then to the first coating solution applied, the second coating solution and the basic compound-containing solution are applied simultaneously (which is also referred to as simultaneous multilayer coating).

The simultaneous coating (simultaneous multilayer coating) can be performed with known coating apparatus, such as an extrusion die coater or a curtain flow coater.

A method of applying the basic compound-containing solution "(2) at a stage in the course of drying of the coating layers formed by applying at least the first coating solution and the second coating solution, and that before the coating layer shows falling-rate drying" is the method referred to as "Wet-On-Wet method" or "WOW method". Details of "Wet-On-Wet method" are described, e.g., in JP-A No. 2005-14593, paragraphs [0016] to [0037].

In the invention, application of the basic compound-containing solution can be carried out as follows: After a coating layer is formed by performing simultaneous coating (multilayer coating) or sequential coating of the first coating solution and the second coating solution (and further the other coating solution as required) so that these solutions are applied in this order from the substrate side, the basic compound-containing solution is applied at a stage in the course of drying of the coating layer formed, and that before the coating layer shows falling-rate drying, according to (i) a method of further applying the basic compound-containing solution to the coating layer formed, (ii) a method of spraying the basic compound-containing solution on the coating layer formed, or (iii) a method of immersing the coating layer-provided substrate in the basic compound-containing solution.

Method available for applying the coating solution of the basic compound-containing layer in the method (i) include methods known in the art such as using a curtain flow coater, extrusion die coater, air doctor coater, blade coater, rod coater, knife coater, squeeze coater, reverse roll coater and bar coater. The methods of using an extrusion die coater or curtain flow coater are preferable, since these methods are able to apply the coat without making direct contact with the already formed coating layer.

The expression "before the coating layer shows falling-rate drying" usually refers to a period of several minutes from immediately after the application of coating solutions for the ink receiving layer (which include the first coating solution and the second coating solution (and further the other coating solution as required) in the invention), and in this course, the coating layer applied exhibits the phenomenon of "constant-rate drying" in which the solvent (dispersion medium) content in the coating layer applied decreases in proportion to a lapse of time. On the time for such "constant-rate drying", there are descriptions in, e.g., Kagaku Kogaku Binran (Handbook of Chemical Technology), pages 707-712, MARUZEN Co., Ltd. (Oct. 25, 1980).

As to conditions for drying the coating layer until it comes to show falling-rate drying, they are generally chosen from the drying temperature range of 40° C. to 180° C. and the drying time range of from 0.5 minutes to 10 minutes (preferably from 0.5 minutes to 5 minutes). Although it is natural that the drying time varies according to the coating amount, the range specified above is usually appropriate.

(Basic Compound-Containing Solution)

Hereafter, the basic compound-containing solution for use in the cross-link hardening process is described.

Basic Compound:

The basic compound-containing solution for use in the invention contains at least one basic compound.

Examples of the basic compound include ammonium salts of weak acids, alkali metal salts of weak acids (such as lithium carbonate, sodium carbonate, potassium carbonate, lithium acetate, sodium acetate and potassium acetate), alkaline earth metal salts of weak acids (such as magnesium carbonate, barium carbonate, magnesium acetate and barium acetate), ammonium hydroxide, primary to tertiary amines (such as triethylamine, tripropylamine, tributylamine, trihexylamine, dibutylamine and butylamine), primary to tertiary anilines (such as diethylaniline, dibutylaniline, ethylaniline and aniline) and pyridines which may have a substituent (such as 2-aminopyridine, 3-aminopyridine, 4-aminopyridine and 4-(2-hydroxyethyl)-aminopyridine).

In addition to the basic compounds described above, combinations of those basic compounds with other basic substances and/or salts thereof can also be used. Examples of the other basic substances include ammonia, primary amines such as ethylamine and polyallylamine, secondary amines such as dimethylamine, tertiary amines such as N-ethyl-N-methylbutylamine, and hydroxides of alkali metals and alkaline earth metals.

The content of the basic compound (especially an ammonium salt of a weak acid) in the basic compound-containing solution is preferably from 0.5% by mass to 10% by mass, and more preferably from 1% by mass to 5% by mass, with respect to total mass (including the solvent) of the basic compound-containing solution. By adjusting the content of the basic compound (especially an ammonium salts of a weak acid) to the foregoing range in particular, a sufficient degree of hardening can be attained and impairment of a working environment due to too high an ammonia concentration can be avoided.

Metal Compound

The basic compound-containing solution for use in the invention preferably contains at least one metal compound.

As to the metal compound to be incorporated in the basic compound-containing solution, any compounds are usable as long as they are stable under basic conditions. Specifically, any of the water-soluble polyvalent metal salts as described above, metal complex compounds, inorganic oligomers and inorganic polymers may be used. More specifically, zirconium compounds and the compounds listed as inorganic mordants in JP-A No. 2005-14593, paragraphs [0100] and [0101], are used to advantage. And examples of usable metal complex compounds include the metal complexes described in Kagaku Sosetsu (Review of Chemistry), No. 32 (1981), edited by The Chemical Society of Japan, and the transition metal complexes containing transition metals including ruthenium as described in Coordination Chemistry Review, vol. 84, pages 85-277 (1988), and JP-A No. 2-182701.

The content of a metal compound (a zirconium compound in particular) in the basic compound-containing solution is preferably from 0.05% by mass to 5% by mass, and more preferably from 0.1% by mass to 2% by mass, with respect to total mass (including the solvent) of the basic compound-containing solution. By adjusting the content of a metal compound (a zirconium compound in particular) to the foregoing range, not only the hardening of the coating layer can be fully achieved, but also insufficient print density and beading due to reduction in mordanting capability can be avoided, and besides, no deterioration of a working environment due to too high a concentration of basic compound, such as ammonia, is caused. Additionally, two or more metal compounds may be used in combination. When a metal compound is used in combination with a mordant other than metal compounds among the mordant components described hereafter, the mordant can be used in such an amount that the total content of the metal compound and the mordant falls within the range specified above and there occurs no impairment of effects of the invention.

In terms of image density and ozone resistance, it is also preferable that the basic compound-containing solution contains, as a metal compound, any of the magnesium salts described above. As the magnesium salt contained, magnesium chloride is particularly suitable.

In this case, the amount of the magnesium salt added is preferably from 0.1% by mass to 1% by mass, and more preferably from 0.15% by mass to 0.5% by mass, with respect to total mass of the basic compound-containing solution.

The basic compound-containing solution can contain a crosslinking agent and other mordant components as required.

The basic compound-containing solution can accelerate hardening when used in a state of alkaline solution, so the pH thereof is preferably adjusted to 7.1 or higher, more preferably to 8.0 or higher, and particularly preferably to 9.0 or higher. When the pH is 7.1 or higher, the crosslinking reaction of the water-soluble resin which may be contained in the first coating solution and/or the second coating solution can be further promoted, and bronzing and cracking in the ink receiving layer can be prevented more effectively.

The basic compound-containing solution can be prepared, for example, by adding, to ion exchange water, a metal compound (such as a zirconium compound at, for example, a concentration of 1% to 5%) and a basic compound (such as ammonium carbonate at, for example, 1% to 5%), and further paratoluenesulfonic acid (at, for example, 0.5% to 3%) as required, and then thoroughly stirring them. Additionally, "%" for each ingredient represents % by mass of solids.

As to the solvent for preparation of the basic compound-containing solution, water, an organic solvent or a mixture thereof is usable. Examples of an organic solvent which can be used for application include alcohol compounds such as methanol, ethanol, n-propanol, isopropanol and methoxypropanol, ketones such as acetone and methyl ethyl ketone, tetrahydrofuran, acetonitrile, ethyl acetate and toluene.

<Cooling Process and Drying Process>

The second exemplary embodiment has a process of cooling the coating layer formed in the coating layer formation process to a temperature at least 5° C. lower than the lower one of temperatures at which the first coating solution and the second coating solution are applied, respectively (hereinafter referred to as "a cooling process" too), and a process of forming an ink receiving layer by drying the coating layer cooled (hereinafter referred to as "a drying process" too).

As a method of cooling the coating layer in the cooling process, it is preferable to adopt a method of cooling the substrate, on which the coating layer is formed, in a cooling zone kept at temperatures ranging from 0° C. to 10° C., and performing cooling for 5 seconds to 30 seconds. In the cooling process, it is preferable to cool to be lower by 0° C. to 10° C., and more preferable by 0° C. to 5° C.

Herein, the temperature of the coating layer can be determined by temperature measurement made on the coating surface.

<Other Processes>

In the first exemplary embodiment and the second exemplary embodiment, the surface smoothness, glossiness, transparency and strength of coated layer may be improved by applying calender treatment by heating and passing the sheet through roll nips under pressure, using a super calender or gloss calender machine after the ink receiving layer is formed on the substrate.

—Ink—

Although either a pigment ink including a pigment as a colorant, or a dye ink including a dye as a colorant may be used as the ink, a dye-containing ink is preferable from the viewpoint of the relationship with the inkjet recording medium of the invention, specifically, that the ink receiving layer that is close to the substrate contains the nitrogen-containing organic cationic polymer in a high content. Since the dye penetrates to the layer that is close to the substrate in the ink receiving layer, generation of bleeding may be suppressed more effectively.

The ink may be a black ink, or a color ink such as a red, green or blue ink. Furthermore, glycol ether may be added to the ink, whereby the property of the ink to penetrate to the recording medium is improved and an image in which image bleeding is suppressed may be expected.

The dye is not specifically limited, and examples may include water-soluble acidic dyes, direct dyes, basic dyes and reactive dyes described in the COLOR INDEX. Furthermore, the water-soluble dye represented by the following Formula (M) or (Bk) is preferable, from the viewpoint that the dye penetrates to the layer that is close to the substrate in the ink receiving layer to exhibit an effect for suppressing bleeding. In this regard, the water-soluble dye refers to a dye that dissolves at 1% by mass or more in water at 20° C.

Formula (M)

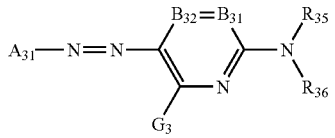

In Formula (M), $A_{31}$ is a 5-membered heterocyclic group, $B_{31}$ and $B_{32}$ are each $=CR_{31}-$ or $-CR_{32}=$, or one is a nitrogen atom and the other is $=CR_{31}-$ or $-CR_{32}=$, $R_{35}$ and $R_{36}$ are each independently a hydrogen atom, an aliphatic group, an aromatic group, a heterocyclic group, an acyl group, an alkoxycarbonyl group, an aryloxycarbonyl group, a heterocyclic oxycarbonyl group, a carbamoyl group, an alkylsulfonyl group, an arylsulfonyl group, a heterocyclic sulfonyl group, or a sulfamoyl group, wherein each group may further have a substituent.

$G_3$, $R_{31}$ and $R_{32}$ are each independently a hydrogen atom, a halogen atom, an aliphatic group, an aromatic group, a heterocyclic group, a cyano group, a carboxy group, a carbamoyl group, an alkoxycarbonyl group, an aryloxycarbonyl group, a heterocyclic oxycarbonyl group, an acyl group, a hydroxy group, an alkoxy group, an aryloxy group, a heterocyclic oxy group, a silyloxy group, an acyloxy group, a carbamoyloxy group, an alkoxycarbonyloxy group, an aryloxycarbonyloxy group, an amino group (including an arylamino group and a heterocyclic amino group), an acylamino group, a ureido group, a sulfamoylamino group, an alkoxycarbonylamino group, an aryloxycarbonylamino group, an alkylsulfonylamino group, an arylsulfonylamino group, a heterocyclic sulfonylamino group, a nitro group, an alkylthio group, an arylthio group, an alkylsulfonyl group, an arylsulfonyl group, a heterocyclic sulfonyl group, an alkylsulfinyl group, an arylsulfinyl group, a heterocyclic sulfinyl group, a sulfamoyl group, a sulfonic acid group, or a heterocyclic thio group, wherein each group may further have a substituent.

$R_{31}$ and $R_{35}$, or $R_{35}$ and $R_{36}$ may link together to form a 5- or 6-membered ring.

At least one of $A_{31}$, $R_{31}$, $R_{32}$, $R_{35}$, $R_{36}$ and $G_3$ has a sulfonic acid group and a $Li^+$ or quaternary ammonium ion as a counter ion.

Specific examples of the water-soluble dye represented by Formula (M) include ones in which the water-soluble group is only a sulfonic acid group and the counter ion is a $Li^+$ ion or a quaternary ammonium ion, among the water-soluble dyes described in WO2002/83795 (pages 35 to 55), WO2002/83662 (pages 27 to 42), JP-A No. 2004-149560 (paragraphs to [0059]) and JP-A No. 2004-149561 (paragraphs [0047] to [0060]).

Among the water-soluble dyes represented by Formula (M), specifically preferable specific examples are shown below by the structures of free acid. However, the dyes are preferably used in the form of a salt.

M-A

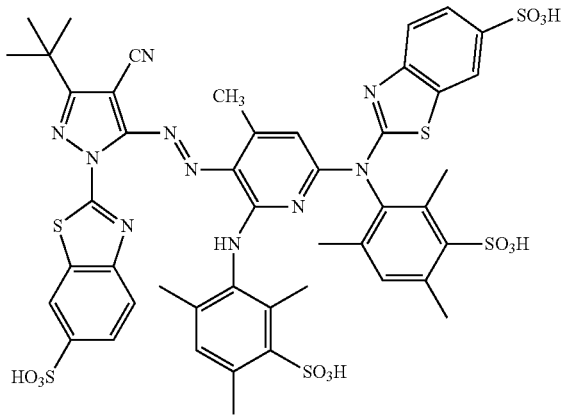

M-B

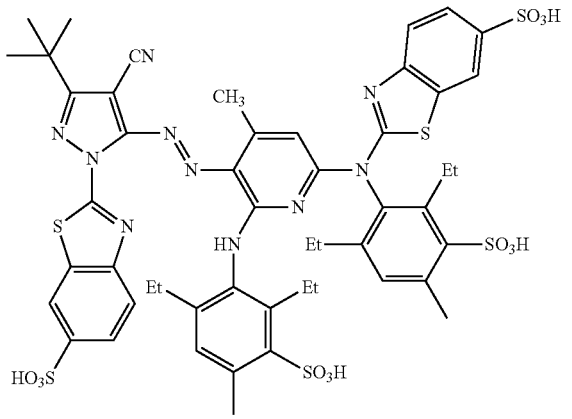

M-C

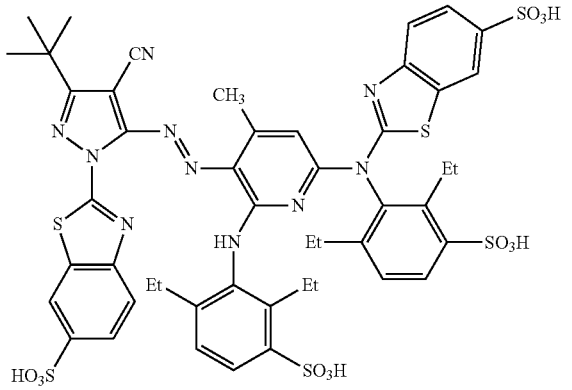

Where the water-soluble dye represented by Formula (M) (heterocyclic azo dye) is used, the content thereof in a magenta ink is preferably from 0.2% by mass to 20% by mass, and more preferably from 0.5% by mass to 15% by mass.

$A_1$-N=N-$A_2$-N=N-$A_3$ Formula (Bk)

In Formula (Bk), $A_1$, $A_2$ and $A_3$ are each independently a substituted or unsubstituted aromatic group or a substituted or unsubstituted heterocyclic group. $A_1$ and $A_3$ are each a monovalent group, and $A_2$ is a divalent group. It is preferable that at least one of $A_1$, $A_2$ and $A_3$ is a heterocyclic group.

Examples of the water-soluble dye represented by Formula (Bk) may include the water-soluble dyes described in JP-A No. 2007-70573, paragraphs [0041] to [0059], and the preferable range thereof is similar to that of the publication.

When the compound represented by Formula (Bk) is used, the content thereof in the ink is preferably from 0.2% by mass to 20% by mass, and more preferably from 0.5% by mass to 15% by mass.

Furthermore, it is preferable that the ink including the water-soluble dye represented by Formula (Bk) further includes a water-soluble short wave dye. Specific examples of the water-soluble short wave dye may include the aqueous dyes described in JP-A No. 2007-70573, paragraphs [0061] to [0072], and the preferable embodiment thereof is similar to that of the publication.

Among the colorants, the pigment is not specifically limited, and either an inorganic or organic pigment may be used.

As the inorganic pigment, titanium oxide and iron oxide, as well as carbon black prepared by a known method such as a contact process, furnace process or thermal process may be used.

As the organic pigment, azo pigments (e.g., azo lake, insoluble azo pigments, condensed azo pigments, chelate azo pigments and the like), polycyclic pigments (e.g., phthalocyanine pigments, perylene pigments, perynone pigments, anthraquinone pigments, quinacridone pigments, dioxazine pigments, thioindigo pigments, isoindolinone pigments, quinophthalone pigment and the like), dye chelates (e.g., basic dye chelates, acidic dye chelates and the like), nitro pigments, nitroso pigments, aniline black and the like may be used.

These pigment may be added to the ink as a pigment dispersion liquid obtained by dispersing the pigment in an aqueous medium using a dispersant or a surfactant. As the dispersant, dispersants that are conventionally used for preparing a pigment dispersion liquid such as polymer dispersing agents may be used.

As the ink used in the invention, an ink including at least one of the water-soluble dyes represented by Formulas (M) or (Bk), and an aqueous medium is preferable. By performing recording using a combination of this ink and the inkjet recording medium of the invention as mentioned above, the suppression of bleeding over time, high image density and ozone resistance of the image may further be improved.

Where necessary, the ink may include other additives besides the colorant to the extent that the effect of the invention is not deteriorated.

Examples of the other additives may include known additives such as boric compounds, drying inhibitors (wetting agents), discoloration inhibitors, emulsion stabilizers, penetration enhancers, ultraviolet absorbents, preservatives, fungicides, pH adjusting agents, surface tension adjusting agents, defoaming agents, viscosity adjusting agents, dispersants, dispersion stabilizers, antirusts and chelating agents.

The aqueous medium includes water as a main component, and when necessary, a mixture with a water-miscible organic solvent may be used. Examples of the water-miscible organic solvent include alcohols (e.g., methanol, ethanol, propanol, isopropanol, butanol, isobutanol, sec-butanol, t-butanol, pentanol, hexanol, cyclohexanol, and benzyl alcohol), polyhydric alcohols (e.g., ethylene glycol, diethylene glycol, triethylene glycol, polyethylene glycol, propylene glycol, dipropylene glycol, polypropylene glycol, butylene glycol, hexanediol, pentanediol, glycerine, hexanetriol, and thiodiglycol), glycol derivatives (e.g., ethylene glycol monomethyl ether, ethylene glycol monoethyl ether, ethylene glycol monobutyl ether, diethylene glycol monomethyl ether, diethylene glycol monobutyl ether, propylene glycol monomethyl ether, propylene glycol monobutyl ether, dipropylene glycol monomethyl ether, triethylene glycol monomethyl ether, ethylene glycol diacetate, ethylene glycol monomethyl ether acetate, triethylene glycol monomethyl ether, triethylene glycol monoethyl ether, and ethylene glycol monophenyl ether), amines (e.g., ethanolamine, diethanolamine, triethanolamine, N-methyldiethanolamine, N-ethyldiethanolamine, morpholine, N-ethylmorpholine, ethylenediamine, diethylenetriamine, triethylenetetramine, polyethyleneimine, and tetramethylpropylenediamine), and other polar solvents (e.g., formamide, N,N-dimethylformamide, N,N-dimethylacetamide, dimethylsulfoxide, sulfolane, 2-pyrrolidone, N-methyl-2-pyrrolidone, N-vinyl-2-pyrrolidone, 2-oxazolidone, 1,3-dimethyl-2-imidazolidinone, acetonitrile, and acetone). Two or more kinds of the water-miscible organic solvents may be used in combination.

The drying inhibitor may prevent the ink jetting outlet of the nozzle used in the inkjet recording system from clogging due to drying of the ink. As the drying inhibitor, a water-soluble organic solvent having a vapor pressure lower than that of water is preferable.

Specific examples of the drying inhibitor include polyhydric alcohols such as ethylene glycol, propylene glycol, diethylene glycol, polyethylene glycol, thiodiglycol, dithiodiglycol, 2-methyl-1,3-propanediol, 1,2,6-hexanetriol, acetylene glycol derivatives, glycerine and trimethylolpropane; lower alkyl ethers of polyhydric alcohols such as ethylene glycol monomethyl (or ethyl)ether, diethylene glycol monomethyl (or ethyl)ether and triethylene glycol monoethyl (or butyl) ether; heterocycles such as 2-pyrrolidone, N-methyl-2-pyrrolidone, 1,3-dimethyl-2-imidazolidinone and N-ethylmorpholine; sulfur-containing compounds such as sulfolane, dimethylsulfoxide and 3-sulfolene; polyfunctional compounds such as diacetone alcohol and diethanolamine; and urea derivatives.

Among these, polyhydric alcohols such as glycerine and diethylene glycol are more preferable. The drying inhibitors may be used solely or in a combination of two or more of them. It is preferable that the drying inhibitor is included in the ink by the range from 10% by mass to 50% by mass.

The penetration enhancer allows better penetration of the ink to paper. Examples of the penetration enhancer may include alcohols such as ethanol, isopropanol, butanol, di (tri) ethylene glycol monobutyl ether and 1,2-hexanediol, sodium lauryl sulfate, sodium oleate, nonionic surfactants, and the like.

Generally, a sufficient effect may be obtained by incorporating the penetration enhancer into the ink in a range of from 5% by mass to 30% by mass. It is preferable that the penetration enhancer is used in the range of the amount at which the bleeding of the image and print through are not generated.

The ultraviolet absorbent may improve the storage stability of the image. Examples of the ultraviolet absorbent may include the benzotriazole compounds described in JP-A Nos. 58-185677, 61-190537, 2-782, 5-197075, 9-34057 and the like; the benzophenone compounds described in JP-A Nos. 46-2784, 5-194483 and U.S. Pat. No. 3,214,463 and the like; the cinnamic acid compounds described in JP-B Nos. 48-30492 and 56-21141, JP-A No. 10-88106 and the like; the triazine compounds described in JP-A Nos. 4-298503, 8-53427, 8-239368 and 10-182621, Japanese National Phase Publication (Laid-Open) No. 8-501291, and the like; the compounds described in the Research Disclosure No. 24239; and the compounds that absorb ultraviolet rays and generate fluorescence such as stilbene compounds and benzoxazole compounds, so-called fluorescent brighteners.

The discoloration inhibitor may improve the storage stability of the image. As the discoloration inhibitor, various organic and metal complex discoloration inhibitors may be used. Examples of the organic discoloration inhibitor may include hydroquinones, alkoxyphenols, dialkoxyphenols, phenols, anilines, amines, indanes, chromanes, alkoxyanilines, thioethers, thioureas (examples of the thioethers and thioureas are described in JP-A No. 2002-36717, and examples of thioethers are described in JP-A No. 2002-86904), heterocycles and the like, and examples of the metal complex discoloration inhibitor include nickel complexes, zinc complexes and the like. More specifically, the compounds described in the patents cited by the Research Disclosure Nos. 17643 (Part VII, Sections I to J), 15162, 18716 (page 650, left column), 36544 (page 527), 307105 (page 872) and 15162; and the compounds included in the formulas and compound examples of the representative compounds described in page 127 to page 137 of JP-A No. 62-215272 may be used.

Examples of the fungicide include sodium dehydroacetate, sodium benzoate, sodium pyridinethione-1-oxide, p-hydroxybenzoic acid ethyl ester and 1,2-benzisothiazolin-3-one, salts thereof, and the like. The fungicide is preferably included in the ink in a range of from 0.02% by mass to 1.00% by mass.

As the pH adjusting agent, a neutralizing agent (an organic base, an inorganic alkali) may be used. The pH adjusting agent is added so that the pH (at 25° C.) of the ink becomes preferably from 6 to 10, and more preferably from 7 to 10, in order to improve the storage stability of the ink.

Example of the surface tension adjusting agent includes nonionic, cationic or anionic surfactants.

The surface tension (at 25° C.) of the ink is preferably from 25 mN/m to 70 mN/m, and more preferably from 25 mN/m to 60 mN/m. The viscosity (at 25° C.) of the ink is preferably adjusted to 30 mPa·s or less, and more preferably 20 mPa·s or less.

Preferable examples of the surfactant include anionic surfactants such as aliphatic acid salts, alkyl sulfonate esters, alkylbenzene sulfonates, alkylnaphthalene sulfonates, dialkyl sulfosuccinates, alkylphosphate esters, naphthalene sulfonate formalin condensates, polyoxyethylenealkyl sulfonate esters; nonionic surfactants such as polyoxyethylene alkyl ethers, polyoxyethylene alkyl allyl ethers, polyoxyethylene aliphatic acid esters, sorbitan aliphatic acid esters, polyoxyethylene sorbitan aliphatic acid esters, polyoxyethylene alkyl amines, glycerine aliphatic acid esters and oxyethylene-oxypropylene block copolymers. Furthermore, SURFYNOLS (trade name, manufactured by AirProducts & Chemicals), which is an acetylene polyoxyethylene oxide surfactant, is also preferably used. Moreover, amphoteric surfactants such as amine oxide surfactants such as N,N-dimethyl-N-alkylamine oxide, and quaternary ammonium salt-containing betaine surfactants such as N,N-dimethyl-N-laurylcarbomethyl ammonium are also preferable. In addition, the surfactants described in JP-A No. 59-157636 (pages (37) and (38)) and the Research Disclosure No. 308119 (1989) may also be used.

Examples of the defoaming agent may include fluoro compounds and silicone compounds. Where necessary, chelate agents such as EDTA may be used.

The method for preparing the ink is not specifically limited, and descriptions of JP-A Nos. 5-148436, 5-295312, 7-97541, 7-82515, 7-118584 and 2004-331871 may be applied.

The ink used in the invention may be an ink set including at least a yellow ink including a yellow dye and a cyan ink including a cyan dye.

The yellow dye is not specifically limited, and examples of the yellow dye may include those described in JP-A No. 2007-70573, paragraphs [0025] to [0040] and the like. The cyan dye is not specifically limited, and examples of the cyan dye may include those described in JP-A No. 2007-70753, paragraphs [0083] to [0090] and the like.

[Drying Process]

In the drying process, at least the image recorded on the inkjet recording medium in the image recording process is dried. Since the ink solvent provided together with the ink easily penetrates through the ink receiving layer, a high quality image in which color change is suppressed may be obtained by performing a drying treatment after recording.

The drying is performed by subjecting the image recorded on the ink receiving layer of the inkjet recording medium of the invention to a drying treatment. Examples of the drying treatment may include a method including heating with a heat source such as a nichrome wire heater, a method including supplying warm air or hot air, a method including irradiating an electromagnetic wave.

In the invention, a method in which the liquid component in the image portion or recording medium may be directly heated by supplying warm air or hot air, heating by using a heat source, or the like, is more preferable than a method including providing heat from the image surface or medium surface, from the viewpoints of prevention of the adverse effect of the heating in the vicinity of the inkjet head on the recording quality, and suppression of the amount of heat required for the drying. Examples include dielectric heating such as microwave heating, and microwave heating is preferable.

The dielectric heating is a heating mode in which an object to be heated (in this case, the ink image, ink receiving layer or inkjet recording medium) is put into a high frequency alternate electric field at from several MHz to several hundred MHz, and the temperature is raised to evaporate the liquid component by heat generation of the object to be heated by the action of a high frequency wave (electromagnetic wave), which may be performed using a high-frequency dielectric heating apparatus or the like. Examples of the dielectric heating include microwave heating, high frequency wave dielectric heating and the like.

The microwave heating means evaporation of the liquid component by heat generation from the inside of the object to be heated by the interaction between a microwave and the object to be heated, which may be performed by using a microwave generating apparatus. Specific examples may include a microwave drying means described in Japanese Patent No. 2979393, a microwave irradiation means for irradiating a microwave generated in a magnetron described in Japanese Patent No. 3302177, and the like.

The infrared heating means that an energy that is resonance-absorbed by the object to be heated induces the motion (oscillation) of molecules and generates heat by their friction to evaporate the liquid component, which may be performed by using a halogen lamp, a ceramic far-infrared heater, an ultra far-infrared heater, an infrared lamp or the like.

In the method for inkjet recording of the invention, the drying is preferably performed by providing heat in an amount of 2 kJ (Joule) or less per 102 mm×152 mm (KG size). By utilizing the dielectric heating, infrared heating or the like, the drying may be performed by an energy in which the amount of heat for drying in the drying process is maintained or decreased as compared with the conventional methods. The drying is performed preferably by providing heat in an amount of 1 kJ or less per 102 mm×152 mm (KG size), preferably in an amount of 0.5 kJ or less per 102 mm×152 mm (KG size) by microwave heating or infrared heating, from the viewpoint of saving heat energy.

In the drying process of the invention, it is preferable that the drying is started (i.e., heater-on), or the irradiation of an electromagnetic wave or microwave, or supply of warm air or heat air is started, within 20 seconds from the completion of the jetting of the ink in the image recording process. It is more preferable that the drying is started within 10 seconds after the completion of the jetting of the ink, from the viewpoints of apparatus size and productivity.

As used herein, the completion of the jetting of the ink refers to the time point at which the ink droplets jetted from the nozzle of the inkjet head are finally spotted on the ink receiving layer.

The image recording according to the method for inkjet recording of the invention may be performed by using the inkjet recording apparatus that is constituted as shown in, for example, FIG. 1. FIG. 1 is a schematic constitutional drawing viewed from the direction orthogonal to the running direction A of the inkjet recording paper on the same plane surface.

The inkjet recording apparatus shown in FIG. 1 has a recording head (inkjet head), and reservoir tanks (not depicted) corresponding to the number of the hues to be used are connected to the inkjet head. A stage having a suction mechanism is provided in the direction of the ink jetting from the recording head, whereby the inkjet recording medium may be transferred between the recording head and the stage. The suction mechanism aspirates the surface of the stage by, for example, vacuum suction of the inside of the stage, or the like, whereby the inkjet recording medium supplied to the stage is temporarily fixed on the stage. The stage temporarily sucks and fixes the transferred inkjet recording medium, and may move in the horizontal direction at a desired velocity so that the spotting position of the ink droplet jetted from the recording head may be selected by the movement.

As shown in FIG. 1, a roll of the inkjet recording medium wind into a roll is attached on the upstream side of the stage in the running direction A along which the inkjet recording paper runs. A plurality of roller pairs that may be driven are provided on the downstream side of the stage in the running direction A, and a drying apparatus is provided between the rollers. Using the drying apparatus, an electromagnetic wave or microwave is irradiated to the image, and where necessary, warm air or heat air may further be supplied to the image. Furthermore, a cutter for cutting the recorded inkjet recording paper into a sheet having a desired size is provided between the stage and drying apparatus, and the recorded inkjet recording medium is dried after cutting. A collecting portion for collecting the sheet-like inkjet recording medium via a transfer roll is provided on the further downstream side of the drying apparatus in the running direction A, in which a plurality of sheets of the transferred recorded inkjet recording medium are stacked and collected.

EXAMPLES

Hereinafter the invention is explained with referring to Examples, but the invention is not limited thereto unless the invention departs from its purport. In the following Examples, the "part(s)" refers to "part(s) by mass" unless specifically mentioned.

Example 1

Preparation of Inkjet Recording Medium

<Preparation of Substrate>

Wood pulp including LBKP (100 parts) was beated up to the Canadian Freeness of 300 mL using a double disc refiner. Epoxylated behenic acid amide (0.5 parts), anionic polyacrylamide (1.0 parts), polyamide polyamine epichlorohydrin (0.1 parts) and cationic polyacrylamide (0.5 parts) were added, all by an absolute dry mass ratio with respect to the pulp, and the amount was measured by a long web papermaking machine to give a base paper of 170 g/m$^2$.

In order to adjust the surface size of the base paper, a fluorescent brightener (trade name: WHITEX BB, manufactured by Sumitomo Chemical Co., Ltd.) (0.04%) was added to a 4% aqueous polyvinyl alcohol solution, with which the base paper was impregnated so that the absolute dry weight equivalent became 0.5 g/m$^2$. The paper was dried and further subjected to a calendar treatment to give a substrate paper in which the density had been adjusted to 1.05.

The wire surface (back surface) of the obtained substrate paper was subjected to a corona discharge treatment, and high-density polyethylene was applied thereon so that its thickness became 19 μm using a melt extruder to form a resin layer including a matt surface (hereinafter this resin layer surface is referred to as "back surface"). The back resin layer was further subjected to a corona discharge treatment, and a dispersion liquid in which aluminum oxide (trade name: ALUMINA SOL 100, manufactured by Nissan Chemical Industries, Ltd.) and silicone dioxide (trade name: SNOWTEX O, manufactured by Nissan Chemical Industries, Ltd.), as an antistatic agents, had been dispersed in water in a mass ratio of 1:2 was applied so that the dry weight became 0.2 g/m$^2$.

Furthermore, the felt surface (front surface) on which the resin layer had not been provided was subjected to a corona discharge treatment. Low-density polyethylene including anatase titanium dioxide (10%), ultramarine blue (trace amount), and a fluorescent brightener (0.01%) (with respect to polyethylene) and having a MFR (melt flow rate) of 3.8 was melt extruded using a melt extruder so that the thickness thereof became 29 μm to form a thermoplastic resin layer having a high gloss on the front surface of the substrate paper (hereinafter this high gloss surface is referred to as "front surface") to give a substrate used in this Example.

<Preparation of Coating Solution>

The (1) vapor-phase process silica fine particles, (2) ion exchange water, (3) SHAROLL DC-902P and (4) ZA-30 shown in the composition mentioned below were mixed and dispersed using a liquid-liquid collision type dispersing machine (trade name: ULTIMIZER, manufactured by Sugino Machine Limited), and the obtained dispersion liquid was heated to 45° C. and maintained for 20 hours. Thereafter (5) polyvinyl alcohol solution and (6) SUPERFLEX 650 were added to the dispersion liquid at 30° C. to prepare a coating solution.

—Composition of Coating Solution—

| | |
|---|---|
| (1) Vapor-phase process silica fine particles (inorganic fine particles) (trade name: AEROSIL300SF75, manufactured by Nippon Aerosil Co., Ltd.) | 8.9 parts |
| (2) Ion exchange water | 53.3 parts |
| (3) Dispersant (trade name: SHAROLL DC-902P, 51.5% by mass aqueous solution, manufactured by Dai-ichi Kogyo Seiyaku Co., Ltd.) | 0.78 parts |
| (4) Zirconium acetate (trade name: ZA-30, manufactured by Daiichi Kigenso Kagaku Kogyou Co., Ltd.) | 0.48 parts |
| (5) Polyvinyl alcohol (water-soluble resin) solution | 31.2 parts |

—Composition of Polyvinyl Alcohol Solution—

| | |
|---|---|
| PVA-235 (trade name, saponification degree: 88%, polymerization degree: 3500, manufactured by Kuraray Co., Ltd.) | 2.2 parts |
| Ion exchange water | 28.2 parts |
| Diethylene glycol monobutyl ether (trade name: BUTYCENOL 20P, manufactured by Kyowa Hakko Chemical Co., Ltd.) | 0.7 parts |
| Surfactant (trade name: EMULGEN 109P, manufactured by Kao Corporation) | 0.1 parts |
| (6) Nitrogen-containing organic cationic polymer emulsion (trade name: SUPERFLEX 650, manufactured by Dai-ichi Kogyo Seiyaku Co., Ltd.) | 1.1 parts |

<Formation of Ink Receiving Layer>

The front surface of the substrate was subjected to a corona discharge treatment, and the coating solution was applied on the front surface as follows using an extrusion die coater at the coating solution temperature of 38° C. to give a coating layer. Specifically, the coating solution was adjusted to 212 g/m$^2$ and in-line mixed with the following in-line solution at a velocity of 6.6 g/m$^2$, and the mixture was applied.

—Composition of In-Line Solution—

| | |
|---|---|
| (1) Polyaluminum chloride (trade name: ALFINE 83, manufactured by Taimei Chemicals Co., Ltd.) | 2.0 parts |
| (2) Ion exchange water | 7.8 parts |
| (3) Dimethylamine-epichlorohydrin condensate (trade name: HYMAX SC-507, manufactured by Hymo Co., Ltd.) | 0.2 parts |

The coating layer formed by the coating was dried in a hot air drier at 80° C. (air velocity: from 3 m/sec to 8 m/sec) so that the solid content in the coating layer became 24%. During this drying, the coating layer was dried in a constant rate. Immediately after the drying, the coating layer was soaked in a solution including a basic compound having the following composition for 3 seconds to apply the solution at 13 g/m$^2$ on the coating layer, and further dried at 72° C. for 10 minutes (drying process) to form an ink receiving layer on the substrate.

—Composition of Solution Including Basic Compound—

| | |
|---|---|
| (1) Boric acid | 1.3 parts |
| (2) Ammonium carbonate (primary: manufactured by Kanto Chemical Co., Inc.) | 5.0 parts |
| (3) Ammonium zirconyl carbonate (trade name: ZIRCOSOL AC-7, manufactured by Daiichi Kigenso Kagaku Kogyou Co., Ltd.) | 2.5 parts |
| (4) Ion exchange water | 85.2 parts |
| (5) Surfactant (polyoxyethylene lauryl ether, trade name: EMULGEN 109P (10% aqueous solution), manufactured by Kao Corporation, HLB value: 13.6) | 6.0 parts |

According to the above-mentioned manner, a roll-shaped inkjet recording paper including an ink receiving layer having a dry film thickness of 35 μm on a substrate was obtained. This roll-shaped inkjet recording paper was subjected to a slit processing to give rolls of 152 mm width×100 m, which were used as roll samples for evaluation.

<Preparation of Inks>

Deionized water was added to the following components so that the whole amount became 1 L, and the solution was stirred for 1 hour at from 30° C. to 40° C. while heating. Thereafter the pH was adjusted to 9 with an aqueous potassium hydroxide solution (10 mol/L), and the solution was filtered under reduced pressure using a microfilter having an average pore size of 0.25 μm to prepare an ink solution for light magenta.

<Composition>

| | |
|---|---|
| Magenta dye represented by the following formula (Compound M-1) | 7.5 g/L |
| Diethylene glycol | 50 g/L |
| Urea | 10 g/L |
| Glycerine | 200 g/L |
| Triethylene glycol monobutyl ether | 120 g/L |
| Triethanolamine | 6.9 g/L |
| Benzotriazole | 0.08 g/L |
| 2-Pyrrolidone | 20 g/L |
| Surfactant (trade name: SURFYNOL 465, manufactured by AirProducts Japan) | 10.5 g/L |
| Bactericide (trade name: PROXEL XL-2, manufactured by ICI Japan) | 3.5 g/L |

Furthermore, a magenta ink, light cyan ink, cyan ink, yellow ink and black ink were prepared by changing the dye species and additives, and the ink set 101 having the concentrations shown in the following Table 1 was prepared.

TABLE 1

| Dye (g/L) | Light magenta Compound M-1 (7.5) | Magenta Compound M-1 (30.0) | Light cyan Compound C-1 (8.75) | Cyan Compound C-1 (35.0) | Yellow Compound Y-1 (29.0) | Black Compound Bk-1 (21.5) Compound Bk-2 (5.5) |
|---|---|---|---|---|---|---|
| Diethylene glycol (g/L) | 50 | 80 | 170 | 110 | 90 | 10 |
| Urea (g/L) | 10 | 70 | — | — | — | — |
| Glycerine (g/L) | 200 | 150 | 170 | 150 | 150 | 160 |
| Triethylene glycol monobutyl ether (g/L) | 120 | 120 | 130 | 130 | 130 | — |
| Diethylene glycol monobutyl ether (g/L) | — | — | — | — | — | 110 |
| 2-Pyrrolidone (g/L) | 20 | — | — | — | — | 50 |
| SURFYNOL 465 (g/L) | 10.5 | 10 | 9.8 | 10.5 | — | — |
| SURFYINOL STG (g/L) | — | — | — | — | 8.5 | 9.8 |
| Triethanolamine (g/L) | 6.9 | 7 | 6 | 6 | 0.9 | 15 |

TABLE 1-continued
| | | | | | | |
|---|---|---|---|---|---|---|
| Benzotriazole (g/L) | 0.08 | 0.07 | 0.08 | 0.08 | — | 0.06 |
| PROXEL XL2 (g/L) | 3.5 | 1.5 | 1.1 | 1.2 | 1.5 | 1.1 |
Compound M-1
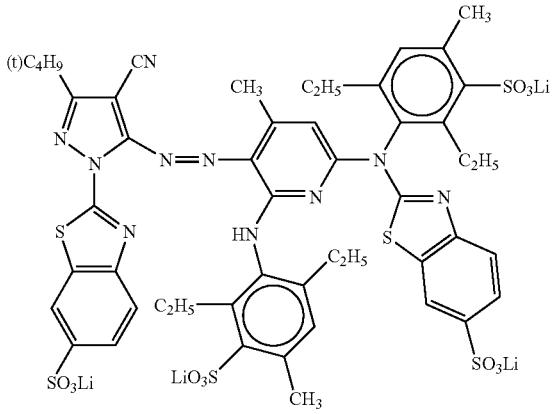
Compound C-1
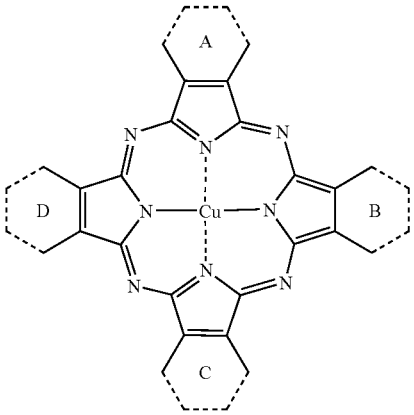
one of the rings A to D is
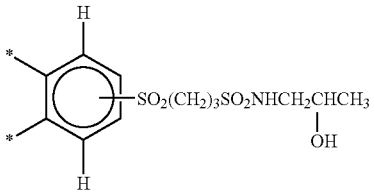
the other three rings are
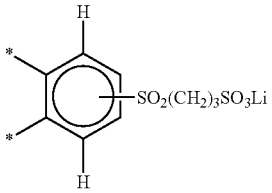
*represents the bonding positions on the phthalocyanine ring
Compound Y-1
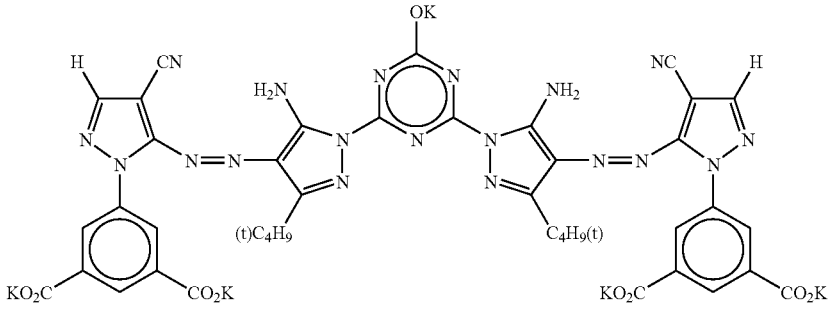

TABLE 1-continued

Compound Bk-1

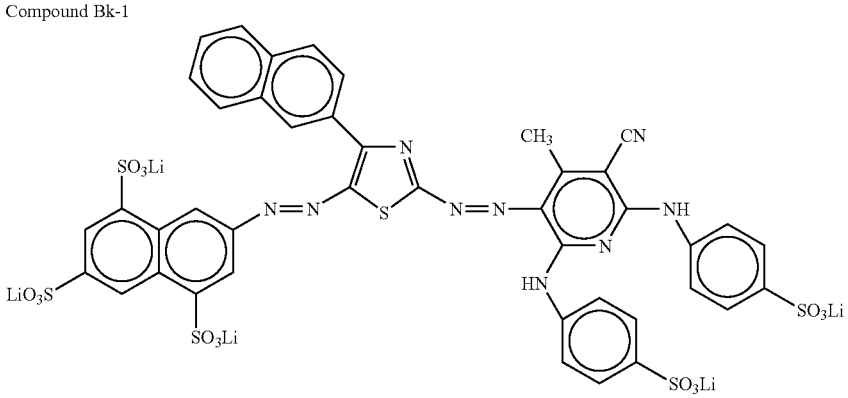

Compound Bk-2

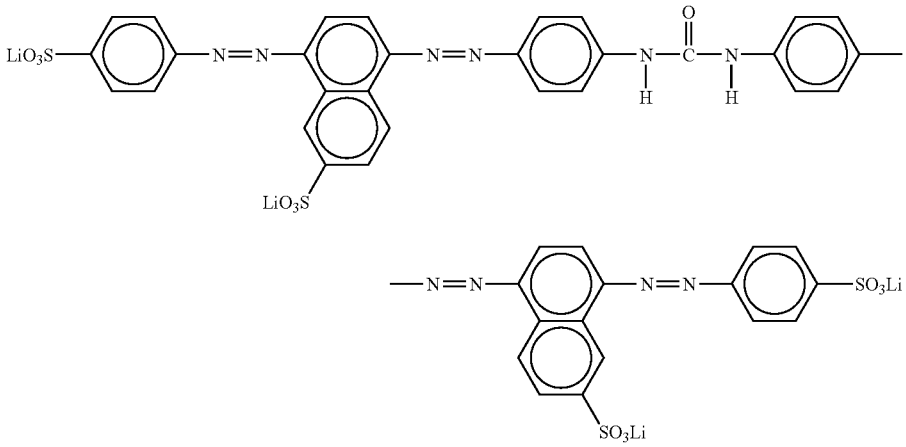

<<Image Recording and Evaluation>>

An image was recorded on the inkjet recording paper obtained as above using the ink set 101 according to the following manner and evaluated. The results of evaluation are shown in the Table 2 described below.

—1. Image Recording—

As an inkjet recording apparatus, the inkjet printer shown in FIG. 1 was prepared. The inkjet printer has a 1200 dpi head (manufactured by FUJIFILM Dimatix, Inc.) as a recording head (inkjet head), with which an image may be recorded by a shuttle scan mode in which ink is jetted while the head is reciprocating in the direction orthogonal to the running direction A (direction of the arrow A) of the recording paper on the same plane surface in FIG. 1 (the anteroposterior direction in FIG. 1). Ink reservoir tanks (not depicted) are connected to the inkjet head. The color inks in the ink set 101 obtained as above were put into the ink reservoir tanks, and a four-color image was recorded.

A stage having a function of vacuum suction is provided in the jetting direction of the ink jetting outlet of the recording head, and the inkjet recording paper may be transferred between the recording head and the stage. The stage temporarily sucks and fixes the running inkjet recording paper at a predetermined position, and is constituted to be capable of linearly moving in the horizontal direction (sub-scanning direction) at 10 mm/second, whereby the spotting position of the ink droplet jetted from the recording head may be selected by the movement of the stage. As shown in FIG. 1, a roll of the inkjet recording paper is attached to the upperstream side of the stage in the running direction A of the recording paper, and a lengthy inkjet recording paper is provided on the stage at a predetermined velocity from the roll. A plurality of roller pairs capable of being driven are provided on the running path of the recording paper on the downstream side of the stage in the running direction A of the recording paper, and a cutter for cutting the inkjet recording paper, a microwave generating apparatus (trade name: ESG-2450S-2A, manufactured by SPC Electronics Corporation) and a drying apparatus having a drying fan (air amount: 3 $m^3$/min, air temperature: 25° C.) are sequentially provided between the rollers. The apparatus has a constitution in which an image is recorded on the inkjet recording paper, the inkjet recording paper is then immediately cut into a desired size and transferred to the drying portion, and the image surface is irradiated with a microwave by the drying apparatus while air is sent to the image surface. After the drying, the sheet-like inkjet recording paper on which the image has been recorded is transferred to a collecting portion provided on the further downstream side, and stacked and collected in the collecting portion.

Alternatively, as shown in FIG. 1, back surface recording may be simultaneously performed by providing a recording means (e.g., an inkjet head) for printing (back printing) on the back surface opposite to the recording surface of the inkjet recording paper on the position across the running path of the inkjet recording paper from the drying apparatus.

When the roll of the inkjet recording paper formed into a roll is attached to the inkjet printer and the inkjet printer is started up, the inkjet recording paper is provided on the stage and fixed thereon. The color inks were sequentially jetted from the recording head by a shuttle scan mode under the conditions of the amount of the ink droplets of 2 pL, the maximum total ejection amount of 20 mL/m$^2$, the jetting frequency of 30 kHz, and the resolution of 1200 dpi×1200 dpi while the fixed inkjet recording paper was transferred to the sub-scanning direction at a constant velocity, whereby a gray solid image was recorded. In this process, the head moved at a velocity of 635 mm/sec. Furthermore, the gradation of the image data was adjusted so that the gray density measured by Gretag Spectrolino SPM-50 (trade name, manufactured by GretagMacbeth; eyesight angle: 2°, light source: D50, no filter) became 1.7.

Immediately after the jetting was completed, the paper was cut into a sheet and transferred to the drying apparatus, and dried by irradiating a microwave (oscillation frequency: 2450 MHz, output: 100 W) for 3.6 seconds from 5 seconds after the completion of the jetting (transfer velocity of the paper: 28 mm/sec). During the drying, dry air at a temperature of 25° C. was also provided. The amount of heat during the drying was 360 J/KG size. After the drying was completed, the sheet was further transferred to the collecting portion to collect the inkjet recording paper on which the solid image had been recorded.

Thus, a gray tone image was obtained on the inkjet recording paper.

—2. Evaluation of Color Tone Change (Color Change)—

The L*a*b* of the gray solid image was measured at immediately after the collection (within 3 minutes after the completion of the drying) and 24 hours after collection, respectively, using a spectrometer (trade name: SPECTROLINO, manufactured by GretagMacbeth) under the conditions of the eyesight angle of 2°, the light source F8 and no filter. The color hue difference (ΔE) was obtained from the measured values and used as an index for evaluating the color tone change. The evaluation was performed using the value of the color hue difference according to the following evaluation criteria. The evaluation results are shown in the following Table 2.

<Evaluation Criteria>

AA: ΔE<2; Little change in color tone is recognized.

A: 2≦ΔE<4; Change in color tone is observed, but was not so noticeable.

B: 4≦ΔE<7; Change in color tone is relatively noticeable.

C: ΔE≧7; Change in color tone is significant.

—3. Evaluation of Image Density (Black Density)—

A black solid was printed using the apparatus loaded with the ink set 101, and the density of the solid image portion was measured by a reflective densitometer (trade name: XRITE 938, manufactured by X-Rite, Incorporated.). The evaluation results are shown in the following Table 2.

—4. Evaluation of Ozone Resistance—

Solid images of yellow color, cyan color and magenta color were printed using the apparatus loaded with the ink set 101, and used as image samples. The obtained color image samples were stored under the atmosphere of 23° C., 60% RH and the ozone concentration of 10 ppm for 80 hours, and residual rate of each of the yellow density, cyan density and magenta density after storage with respect to that before storage was calculated. For the residual rate of the color having the lowest residual rate, the ozone resistance was evaluated according to the following evaluation criteria. The evaluation results are shown in the following Table 2.

<Evaluation Criteria>

A: 75% or more

B: 70% or more and less than 75%

C: 60% or more and less than 70%

D: less than 60%

—5. Evaluation of Continuous Recording Property—

KG size printing was subsequently performed in a similar manner to that in the above "1. Image Recording". The solid images obtained by the continuous printing were visually observed and evaluated according to the following evaluation criteria. The evaluation results are shown in the following Table 2.

<Evaluation Criteria>

AA: Dot loss does not occur and a good image is obtained even after continuous printing on 200,000 sheets.

A: Dot loss does not occur and a good image is obtained even after continuous printing on 100,000 sheets.

B: Dot loss begins to occur after continuous printing on 10,000 sheets.

C: Dot loss begins to occur after continuous printing on 5,000, which is not acceptable for practical use.

—6. Evaluation of Productivity—

KG size printing was subsequently performed and evaluated according to the following evaluation criteria. The evaluation results are shown in the following Table 2.

<Evaluation Criteria>

A: 500 sheets/hour or more

B: less than 500 sheets/hour

Example 2

An inkjet recording paper was obtained in a manner substantially similar to that in Example 1 except that the microwave generating apparatus (trade name: ESG-2450S-2A, manufactured by SPC Electronics Corporation) was replaced with a nichrome wire warm air heater (400 W, heating time: 2 seconds) to send hot air at 60° C. by a drying fan (air amount: 3 m$^3$/min) in Example 1, and an image was recorded thereon and evaluated.

Example 3

An inkjet recording paper was obtained in a manner substantially similar to that in Example 2 except that the nichrome wire warm air heater was replaced with a nichrome wire warm air heater of 200 W, and the transfer velocity of the sheet was reduced to half (the period from the completion of the jetting to the initiation of the drying was changed from 5 seconds to 10 seconds) in Example 2, and an image was recorded thereon and evaluated.

Comparative Example 1

An inkjet recording paper was obtained in a manner substantially similar to that in Example 1 except that drying by irradiation of a microwave and supplying of dry air were not performed after the completion of the jetting in Example 1, and an image was recorded thereon and evaluated.

Comparative Example 2

An inkjet recording paper was obtained in a manner substantially similar to that in Example 1 except that ALFINE 83 (polyaluminum chloride) in the "Composition of In-Line Solution" was not used, ZA-30 in the "Composition of Coating Solution" was not used, and that ZIRCOSOL AC-7 in the "Composition of Solution Including Basic Compound" was not used in the preparation of the ink receiving layer of Example 1, and an image was recorded thereon and evaluated.

TABLE 2

| | Ink receiving layer | Drying | | Time until | Evaluation | | | | |
|---|---|---|---|---|---|---|---|---|---|
| | Water-soluble metal compound | Method | Heat amount [J] (*1) | initiation of drying [sec] | Black density | Ozone resistance | Color change | Continuous recording property | Productivity |
| Example 1 | Polyaluminum chloride | Microwave | 360 | 5 | 2.41 | C | A | A | A |
| Example 2 | Polyaluminum chloride | Hot air | 800 | 5 | 2.42 | C | A | B | A |
| Example 3 | Polyaluminum chloride | Hot air | 800 | 10 | 2.43 | C | A | A | B |
| Comparative Example 1 | Polyaluminum chloride | | — | | 2.41 | C | C | A | A |
| Comparative Example 2 | — | Microwave | 360 | 5 | 2.28 | D | B | A | A |

(*1) The heat amount refers to a heat amount per a KG size (102 mm × 152 mm) [Joule].

As shown in Table 2, the color change after recording is suppressed and excellent continuous recording property and high productivity are maintained in Examples. On the other hand, the color change can not be suppressed in Comparative Examples. Furthermore, the black density and ozone resistance are poor in Comparative Example 2.

Example 4

Preparation of Inkjet Recording Medium

<Preparation of Substrate>

Wood pulp including LBKP (100 parts) was beated up to the Canadian Freeness of 300 mL using a double disc refiner. Epoxylated behenic acid amide (0.5 parts), anionic polyacrylamide (1.0 parts), polyamide polyamine epichlorohydrin (0.1 parts) and cationic polyacrylamide (0.5 parts) were added, all by an absolute dry mass ratio with respect to the pulp, and the amount was by a long web papermaking machine to give a base paper of 170 g/m$^2$.

In order to adjust the surface size of the base paper, a fluorescent brightener (trade name: WHITEX BB, manufactured by Sumitomo Chemical Co., Ltd.) (0.04%) was added to a 4% aqueous polyvinyl alcohol solution, with which the base paper was impregnated so that the absolute dry weight equivalent became 0.5 g/m$^2$. The paper was dried and further subjected to a calendar treatment to give a substrate paper in which the density had been adjusted to 1.05.

The wire surface (back surface) of the obtained substrate paper was subjected to a corona discharge treatment, and high-density polyethylene was applied thereon so that the thickness thereof became 19 μm using a melt extruder to form a resin layer including a matt surface (hereinafter this resin layer surface is referred to as "back surface"). The back resin layer was further subjected to a corona discharge treatment, and a dispersion liquid in which aluminum oxide (trade name: ALUMINA SOL 100, manufactured by Nissan Chemical Industries, Ltd.) and silicone dioxide (trade name: SNOWTEX O, manufactured by Nissan Chemical Industries, Ltd.), as an antistatic agent, had been dispersed in water in a mass ratio of 1:2 was applied so that the dry weight became 0.2 g/m$^2$.

Furthermore, the felt surface (front surface) on which the resin layer had not been provided was subjected to a corona discharge treatment. Lower-density polyethylene including anatase titanium dioxide (10%), ultramarine blue (trace amount), and a fluorescent brightener (0.01%) (with respect to polyethylene) and having a MFR (melt flow rate) of 3.8 was melt extruded using a melt extruder so that the thickness thereof became 29 μm to form a thermoplastic resin layer having a high gloss on the front surface of the substrate paper (hereinafter this high gloss surface is referred to as "front surface") to give a substrate used in this Example.

<Preparation of Second Coating Solution (for Upper Layer)>

The (1) vapor-phase process silica fine particles, (2) ion exchange water, (3) SHAROLL DC-902P and (4) ZA-30 shown in the composition mentioned below were mixed and dispersed using a liquid-liquid collision type dispersing machine (trade name: ULTIMIZER, manufactured by Sugino Machine Limited), and the obtained dispersion liquid was heated to 45° C. and maintained for 20 hours. Thereafter (5) polyvinyl alcohol solution was added to the dispersion liquid at 30° C. to prepare a second coating solution (for upper layer).

The mass ratio of the silica fine particles to the water-soluble resin (PB ratio=(1):(5)) was 4.0:1, and the pH of the second coating liquid (for upper layer) was 3.4 (acidic).

—Composition of Second Coating Solution (for Upper Layer)—

| | |
|---|---|
| (1) Vapor-phase process silica fine particles (inorganic fine particles) (trade name: AEROSIL300SF75, manufactured by Nippon Aerosil Co., Ltd.) | 8.9 parts |
| (2) Ion exchange water | 54.4 parts |
| (3) Dispersant (trade name: SHAROLL DC-902P, manufactured by Dai-ichi Kogyo Seiyaku Co., Ltd.; nitrogen-containing organic cationic polymer) (51.5% aqueous solution) | 0.78 parts |
| (4) Zirconyl acetate (trade name: ZA-30, manufactured by Daiichi Kigenso Kagaku Kogyou Co., Ltd.) | 0.48 parts |
| (5) Polyvinyl alcohol (water-soluble resin) solution | 31.2 parts |

—Composition of Polyvinyl Alcohol Solution—

| | |
|---|---|
| PVA-235 (trade name, saponification degree: 88%, polymerization degree: 3500, manufactured by Kuraray Co., Ltd.) | 2.2 parts |
| Ion exchange water | 28.2 parts |
| Diethylene glycol monobutyl ether (trade name: BUTYCENOL 20P, manufactured by Kyowa Hakko Chemical Co., Ltd.) | 0.7 parts |
| Surfactant (trade name: EMULGEN 109P, manufactured by Kao Corporation) | 0.1 parts |

<Preparation of First Coating Solution (for Lower Layer)>

The (1) vapor-phase process silica fine particles, (2) ion exchange water, (3) SHAROLL DC-902P, (4) ZA-30 and (5) 30% methionine sulfoxide shown in the composition mentioned below were mixed and dispersed using a liquid-liquid collision type dispersing machine (trade name: ULTIMIZER, manufactured by Sugino Machine Limited), and the obtained dispersion liquid was heated to 45° C. and maintained for 20 hours. Thereafter (6) boric acid, (7) polyvinyl alcohol solution and (8) SUPERFLEX 650 were added to the dispersion liquid at 30° C. to prepare a first coating solution (for lower layer).

The mass ratio of the silica fine particles to the water-soluble resin (PB ratio=(1):(7)) was 4.0:1, and the pH of the first coating liquid (for lower layer) was 3.8 (acidic).

—Composition of First Coating Solution (for Lower Layer)—

| | |
|---|---|
| (1) Vapor-phase process silica fine particles (inorganic fine particles) (trade name: AEROSIL300SF75, manufactured by Nippon Aerosil Co., Ltd.) | 8.9 parts |
| (2) Ion exchange water | 48.5 parts |
| (3) Dispersant (trade name: SHAROLL DC-902P, manufactured by Dai-ichi Kogyo Seiyaku Co., Ltd.; nitrogen-containing organic cationic polymer) (51.5% aqueous solution) | 0.78 parts |
| (4) Zirconyl acetate (trade name: ZA-30, manufactured by Daiichi Kigenso Kagaku Kogyou Co., Ltd.) | 0.48 parts |
| (5) Methionine sulfoxide (30% aqueous solution of the sulfur-containing compound (1) mentioned below) | 1.76 parts |
| (6) Boric acid (crosslinking agent) | 0.4 parts |
| (7) Polyvinyl alcohol (water-soluble resin) solution | 31.2 parts |

—Composition of Polyvinyl Alcohol Solution—

| | |
|---|---|
| PVA-235 (trade name, saponification degree: 88%, polymerization degree: 3500, manufactured by Kuraray Co., Ltd.) | 2.2 parts |
| Ion exchange water | 28.2 parts |
| Diethylene glycol monobutyl ether (trade name: BUTYCENOL 20P, manufactured by Kyowa Hakko Chemical Co., Ltd.) | 0.7 parts |
| Surfactant (trade name: EMULGEN 109P, manufactured by Kao Corporation) | 0.1 parts |
| (8) Nitrogen-containing organic cationic polymer emulsion (cationic polyurethane resin fine particles) (trade name: SUPERFLEX 650, manufactured by Dai-ichi Kogyo Seiyaku Co., Ltd.) | 3.1 parts |

Sulfur-containing compound (1)

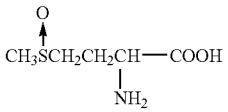

<Formation of Ink Receiving Layer>

The front surface of the substrate was subjected to a corona discharge treatment, and the first coating solution (for lower layer) and the second coating solution (for upper layer) were applied on the front surface according to the following manner by simultaneous multilayer coating using an extrusion die coater at the coating solution temperature of 38° C. for both coating solutions to give coating layers.

Specifically, in the simultaneous multilayer coating, the first coating solution (for lower layer) was adjusted to be applied at 105.1 g/m$^2$ and in-line mixed with the following in-line solution at a velocity of 3.3 g/m$^2$, and the mixture was applied to form the lower layer, and the second coating solution (for upper layer) was adjusted to be applied at 106 g/m$^2$ and in-line mixed with the following in-line solution at a velocity of 13.2 g/m$^2$, and the mixture was applied to form the upper layer (the constitution was second coating solution (for upper layer)/first coating solution (for lower layer)/substrate).

—Composition of In-Line Solution—

| | |
|---|---|
| (1) Polyaluminum chloride (trade name: ALFINE 83, manufactured by Taimei Chemicals Co., Ltd.) | 2.0 parts |
| (2) Ion exchange water | 7.8 parts |
| (3) Dimethylamine-epichlorohydrin condensate (trade name: HYMAX SC-507, manufactured by Hymo Co., Ltd.) | 0.2 parts |

The coating layers formed by the simultaneous multilayer coating were dried in a hot air drier at 80° C. (air velocity: from 3 m/sec to 8 m/sec) so that the solid content in the coating layer became 24%. During this drying, the coating layers were dried in a constant rate. Immediately after the drying, the coating layers were soaked in a solution including a basic compound having the following composition for 3 seconds to apply the solution at 13 g/m$^2$ on the coating layers, and further dried at 72° C. for 10 minutes (drying process) to form an ink receiving layer on the substrate.

—Composition of Solution Including Basic Compound—

| | |
|---|---|
| (1) Boric acid | 1.3 parts |
| (2) Ammonium carbonate (primary: manufactured by Kanto Chemical Co., Inc.) | 5.0 parts |
| (3) Ammonium zirconyl carbonate (trade name: ZIRCOSOL AC-7, manufactured by Daiichi Kigenso Kagaku Kogyou Co., Ltd.) | 2.5 parts |
| (4) Ion exchange water | 85.2 parts |
| (5) Surfactant (polyoxyethylene lauryl ether, trade name: EMULGEN 109P (10% aqueous solution), manufactured by Kao Corporation, HLB value: 13.6) | 6.0 parts |

According to the above-mentioned manner, a roll-shaped inkjet recording paper including an ink receiving layer having a dry film thickness of 35 μm on a substrate was obtained. This roll-shaped inkjet recording paper was subjected to a slit processing to give rolls of 152 mm width×100 m, which were used as roll samples for evaluation.

<<Preparation of Inks>>

Light magenta ink, magenta ink, light cyan ink, cyan ink, yellow ink and black ink were prepared in a manner substantially similar to Example 1, and the ink set 101 having concentrations shown in Table 1 was prepared.

<<Image Recording and Evaluation>>

An image was recorded on the inkjet recording paper obtained as above using the ink set 101 according to the following manner and evaluated. The results of evaluation are shown in Table 3 described below.

—1. Image Recording—

As an inkjet recording apparatus, the inkjet printer shown in FIG. 1 was prepared. The inkjet printer has a 1200 dpi head (manufactured by FUJIFILM Dimatix, Inc.) as a recording head (inkjet head), with which an image may be recorded by a shuttle scan mode in which ink is jetted while the head is reciprocating in the direction orthogonal to the running direction A (direction of the arrow A) of the recording paper in the same plane surface in FIG. 1 (the anteroposterior direction in FIG. 1). Ink reservoir tanks (not depicted) are connected to the inkjet head. The color inks in the ink set 101 obtained as above were put into the ink reservoir tanks, and a four-color image was recorded.

A stage having a function of vacuum suction is provided in the jetting direction of the ink jetting outlet of the recording head, and the inkjet recording paper may be transferred between the recording head and the stage. The stage temporarily sucks and fixes the running inkjet recording paper at a predetermined position, and is constituted so that it may linearly move in the horizontal direction (sub-scanning direction) at 10 mm/second, whereby the jetting position of the ink droplet jetted from the recording head may be selected by the movement of the stage. As shown in FIG. 1, a roll of the inkjet recording paper is attached to the upperstream side of the stage in the running direction A of the recording paper, and a lengthy inkjet recording paper is provided on the stage at a predetermined velocity from the roll. A plurality of roller pairs capable of being driven are provided on the running path of the recording paper on the downstream side of the stage in the running direction A of the recording paper, and a cutter for cutting the inkjet recording paper, a microwave generating apparatus (trade name: ESG-2450S-2A, manufactured by SPC Electronics Corporation) and a drying apparatus having a drying fan (air amount: 3 $m^3$/min, air temperature: 25° C.) are sequentially provided between the rollers. In the apparatus, an image is recorded on the inkjet recording paper, the inkjet recording paper is then immediately cut into a desired size and transferred to the drying portion, and the image surface is irradiated with a microwave by the drying apparatus while air is sent to the image surface. After the drying, the sheet-like inkjet recording paper on which the image has been recorded is transferred to a collecting portion provided on the further downstream side, and stacked and collected in the collecting portion.

Alternatively, as shown in FIG. 1, back surface recording may be simultaneously performed by providing a recording means (e.g., an inkjet head) or the like for printing (back printing) on the back surface opposite to the recording surface of the inkjet recording paper on the position across the running path of the inkjet recording paper from the drying apparatus.

When the roll of the inkjet recording paper formed into a roll is attached to the inkjet printer and the inkjet printer is started up, the inkjet recording paper is provided on the stage and fixed thereon. The color inks were sequentially jetted from the recording head by a shuttle scan mode under the conditions of the amount of the color ink droplets of 2 μL, the maximum total ejection amount of 20 mL/$m^2$, the jetting frequency of 30 kHz, and the resolution of 1200 dpi×1200 dpi while the fixed inkjet recording paper was transferred to the sub-scanning direction at a constant velocity, whereby a gray solid image was recorded. In this process, the head moved at a velocity of 635 mm/sec. Furthermore, the gradation of the image data was adjusted so that the gray density measured by Gretag Spectrolino SPM-50 (trade name, manufactured by GretagMacbeth; eyesight angle: 2°, light source: D50, no filter) became 1.7.

Immediately after the jetting was completed, the paper was cut into a sheet and transferred to the drying apparatus, and dried by irradiating a microwave (oscillation frequency: 2450 MHz, output: 100 W) for 3.6 seconds from 5 seconds after the completion of the jetting (transfer velocity of the paper: 28 mm/sec). During the drying, dry air at a temperature of 25° C. was also provided. The heat amount during the drying was 360 J/KG size. After the drying was completed, the sheet was further transferred to the collecting portion to collect the inkjet recording paper on which the solid image had been recorded.

Thus, a gray tone image was prepared on the inkjet recording paper.

—2. Evaluation of Color Tone Change (Color Change)—

The L*a*b* of the gray solid image was measured at immediately after the collection (within 3 minutes after the completion of the drying) and 24 hours after the collection, respectively, using a spectrometer (trade name: SPECTROLINO, manufactured by GretagMacbeth) under the conditions of the eyesight angle of 2°, the light source F8 and no filter. The color hue difference (ΔE) was obtained from the measured values and used as an index for evaluating the color tone change. The evaluation was performed using the value of the color hue difference according to the following evaluation criteria. The evaluation results are shown in the following Table 3.

<Evaluation Criteria>

AA: ΔE<2; Little change in color tone is recognized.

A: 2≦ΔE<4; Change in color tone is observed, but is not so noticeable.

B: 4≦ΔE<7; Change in color tone is relatively noticeable.

C: ΔE≧7; Change in color tone is significant.

—3. Evaluation of Image Density (Black Density)—

A black solid was printed using the apparatus loaded with the ink set 101, and the density of the solid image portion was measured by a reflective densitometer (trade name: XRITE 938, manufactured by X-Rite Corporation). The evaluation results are shown in the following Table 3.

—4. Evaluation of Ozone Resistance—

Solid images of yellow color, cyan color and magenta color were printed using the apparatus loaded with the ink set 101, and used as image samples. The image samples of the obtained colors were stored in the atmosphere of 23° C., 60% RH and ozone concentration of 10 ppm for 80 hours, and the residual rate of each of the yellow density, cyan density and magenta density after storage with respect to before storage was calculated. For the residual rate of the color having the lowest residual rate, the ozone resistance was evaluated according to the following evaluation criteria. The evaluation results are shown in the following Table 3.

<Evaluation Criteria>

A: 75% or more

B: 70% or more and less than 75%

C: 60% or more and less than 70%

D: less than 60%

—5. Evaluation of Continuous Recording Property—

KG size printing similar to that in the "1. Image Recording" was performed in a continuous manner. The solid images obtained by the continuous printing were visually observed and evaluated according to the following evaluation criteria. The evaluation results are shown in the following Table 3.

<Evaluation Criteria>

AA: Dot loss does not occur and a good image is obtained even after continuous printing on 200,000 sheets.

A: Dot loss does not occur and a good image is obtained even after continuous printing on 100,000 sheets.

B: Dot loss begins to occur after continuous printing on 10,000 sheets.

C: Dot loss begins to occur after continuous printing on 5,000, which is not acceptable for practical use.

—6. Evaluation of Productivity—

KG size printing was continuously performed and evaluated according to the following evaluation criteria. The evaluation results are shown in the following Table 3.

<Evaluation Criteria>

A: 500 sheets/hour or more

B: less than 500 sheets/hour

—7. Confirmation of Existence Distribution of Nitrogen-Containing Organic Cationic Polymer—

The cross-section of the inkjet recording paper was obtained by cutting the paper with a microtome, and a mapping analysis of Si and N elements was performed using SEM-EDX (a combination of S-2150 (trade name, manufactured by Hitachi, Ltd.) and an EDX apparatus). The existence site of the ink receiving layer was confirmed from the mapping image of Si element, and observed together with the mapping image of N element. The evaluation results are shown in the following Table 3.

<Evaluation Criteria>

A: Amount of N element in the lower layer of the ink receiving layer>amount of N element in the upper layer C: Amount of N element in the lower layer of the ink receiving layer<amount of N element in the upper layer —8. Confirmation of Existence Distribution of Water-Soluble Aluminum Compound—

The cross-section of the inkjet recording paper was obtained by cutting the paper with a microtome, and a mapping analysis of Si element and Al element was performed using SEM-EDX (a combination of S-2150 (trade name, manufactured by Hitachi, Ltd.) and an EDX apparatus). The existence site of the ink receiving layer was confirmed from the mapping image of Si element, and observed together with the mapping image of Al element. The evaluation results are shown in the following Table 3.

<Evaluation Criteria>

A: Amount of Al element in the lower layer of the ink receiving layer<amount of Al element in the upper layer C: Amount of Al element in the lower layer of the ink receiving layer≧amount of Al element in the upper layer

Example 5

An inkjet recording paper was obtained in a manner substantially similar to that in Example 4 except that the microwave generating apparatus (trade name: ESG-2450S-2A, manufactured by SPC Electronics Corporation) was replaced with an infrared irradiation apparatus (trade name: H7G-21200, manufactured by NGK Insulators, Ltd., 200 W, irradiation time: 2.4 seconds) in Example 4, and an image was recorded thereon and evaluated.

Example 6

An inkjet recording paper was obtained in a manner substantially similar to that in Example 4 except that the amount of the in-line solution to be incorporated into the second coating solution (for upper layer) was changed from 13.2 $g/m^2$ to 6.6 $g/m^2$ in the preparation of the ink receiving layer of Example 4, and an image was recorded thereon and evaluated.

Example 7

An inkjet recording paper was obtained in a manner substantially similar to that in Example 4 except that the coating solution temperatures of the first and second coating solutions were changed from 38° C. to 42° C. in Example 4, and an image was recorded thereon and evaluated.

Example 8

An inkjet recording paper was obtained in a manner substantially similar to that in Example 4 except that the microwave generating apparatus (trade name: ESG-2450S-2A, manufactured by SPC Electronics Corporation) was replaced with a nichrome wire warm air heater (400 W, heating time: 2 seconds) so as to send hot air at 60° C. by a drying fan (air amount: 3 $m^3$/min) in Example 4, and an image was recorded thereon and evaluated.

Example 9

An inkjet recording paper was obtained in a manner substantially similar to that in Example 4 except that the 30% aqueous solution of methionine sulfoxide (sulfur-containing compound (1)) in the "Composition of First Coating Solution" was replaced with a 30% aqueous solution of the following sulfur-containing compound (2) in Example 4, and an image was recorded thereon and evaluated.

$HO(CH_2)_2S(CH_2)_2S(CH_2)_2OH$ Sulfur-Containing Compound (2)

TABLE 3

| | Ink receiving layer | | | Drying | | Time until initiation of drying [sec] | Evaluation | | | | | | |
|---|---|---|---|---|---|---|---|---|---|---|---|---|---|
| | Constitution | Sulfur-containing compound | Water-soluble metal compound | Method | Heat amount [J] (*1) | | Black density | Ozone resistance | Color change | Continuous recording property | Productivity | Distribution of nitrogen-containing organic cationic polymer | Distribution of water-soluble aluminum compound |
| Example 4 | Multi-layer 1 | Compound (1) | Poly-aluminum chloride | Micro-wave | 360 | 5 | 2.51 | A | AA | A | A | A | A |
| Example 5 | Multi-layer 1 | Compound (1) | Poly-aluminum chloride | Infrared ray | 480 | 5 | 2.52 | A | AA | A | A | A | A |
| Example 6 | Multi-layer 2 | Compound (1) | Poly-aluminum chloride | Micro-wave | 360 | 5 | 2.49 | A | AA | A | A | A | A |
| Example 7 | Multi-layer 1 | Compound (1) | Poly-aluminum chloride | Micro-wave | 360 | 5 | 2.50 | A | AA | A | A | A | A |

TABLE 3-continued

| | Ink receiving layer | | | Drying | | Time until initiation of drying [sec] | Evaluation | | | | | | |
|---|---|---|---|---|---|---|---|---|---|---|---|---|---|
| | Constitution | Sulfur-containing compound | Water-soluble metal compound | Method | Heat amount [J] (*1) | | Black density | Ozone resistance | Color change | Continuous recording property | Productivity | Distribution of nitrogen-containing organic cationic polymer | Distribution of water-soluble aluminum compound |
| Example 8 | Multi-layer 1 | Compound (1) | Poly-aluminum chloride | Hot air | 800 | 5 | 2.51 | A | AA | B | A | A | A |
| Example 9 | Multi-layer 3 | Compound (2) | Poly-aluminum chloride | Micro-wave | 360 | 5 | 2.45 | A | AA | A | A | A | A |

(*1) The heat amount refers to a heat amount per a KG size (102 mm × 152 mm) [Joule].

As shown in Table 3, the color change after recording is suppressed, the continuous recording is successfully performed and high productivity is maintained in each of the Examples.

Although the exemplary embodiments wherein a thioether compound or sulfoxide compound is used as a sulfur-containing compound are explained in the Examples, similar results may be obtained by using the above-mentioned sulfur-containing compounds other than these sulfur-containing compounds.

The invention may provide a method for inkjet recording, with which an image in which the density is high and the color hue difference (color change) has been suppressed may be obtained irrespective of the manner of recording such as two-sided recording, recording on many sheets and recording at a high speed.

Namely, the present invention may provide the following items <1> to <17>.

<1> A method for inkjet recording comprising; recording an image by applying an ink by an inkjet method onto an inkjet recording medium comprising a substrate and an ink receiving layer, the ink receiving layer comprising inorganic fine particles and a water-soluble metal compound provided on the substrate; and drying at least the image recorded on the inkjet recording medium.

<2> The method for inkjet recording according to the item <1>, wherein the inkjet recording medium comprises, on the substrate in this order from the substrate side: a first ink receiving layer comprising inorganic fine particles, a nitrogen-containing organic cationic polymer and an optional water-soluble metal compound; and a second ink receiving layer comprising inorganic fine particles, a water-soluble metal compound and an optional nitrogen-containing organic cationic polymer, wherein a content of the nitrogen-containing organic cationic polymer in the first ink receiving layer is higher than that in the second ink receiving layer, and a content of the water-soluble metal compound in the first ink receiving layer is lower than that in the second ink receiving layer.

<3> The method for inkjet recording according to the item <1> or the item <2>, wherein the inorganic fine particles are selected from the group consisting of silica fine particles, alumina fine particles and pseudo boehmite.

<4> The method for inkjet recording according to any one of the items <1> to <3>, wherein the water-soluble metal compound is a water-soluble aluminum compound.

<5> The method for inkjet recording according to any one of the items <1> to <4>, wherein the drying is performed by providing heat in an amount of 2 kJ or less per 102 mm×152 mm.

<6> The method for inkjet recording according to any one of the items <1> to <5>, wherein the drying is performed by dielectric heating.

<7> The method for inkjet recording according to any one of the items <1> to <5>, wherein the drying is performed by infrared heating.

<8> The method for inkjet recording according to the item <6>, wherein the dielectric heating in the drying is performed by microwave heating.

<9> The method for inkjet recording according to any one of the items <1> to <8>, wherein the drying is started within 20 seconds from the completion of the jetting of the ink in the recording of the image.

<10> The method for inkjet recording according to any one of the items <1> to <9>, wherein the maximum total ejection amount of the ink is from 10 mL/m$^2$ to 36 mL/m$^2$.

<11> The method for inkjet recording according to any one of the items <1> to <10>, wherein the ink is a dye-containing ink comprising a dye as a colorant.

<12> The method for inkjet recording according to the item <2>, wherein the content ratio of the nitrogen-containing organic cationic polymer in the second ink receiving layer with respect to the first ink receiving layer is from 0 to 0.8, and the content ratio of the water-soluble metal compound in the first ink receiving layer with respect to the second ink receiving layer is from 0 to 0.8.

<13> The method for inkjet recording according to the item <2> or the item <12>, wherein the nitrogen-containing organic cationic polymer comprises particles of a cationic polyurethane resin.

<14> The method for inkjet recording according to any one of the items <1> to <13>, wherein the ink receiving layer further comprises a water-soluble resin.

<15> The method for inkjet recording according to any one of the items <2>, <12>, or <13>, wherein at least the first ink receiving layer further comprises a sulfur-containing compound, and a content of the sulfur-containing compound in the first ink receiving layer is higher than that in the second ink receiving layer.

<16> The method for inkjet recording according to the item <15>, wherein the sulfur-containing compound is a thioether compound or a sulfoxide compound.

<17> The method for inkjet recording according to the items <15> or <16>, wherein the content ratio of the sulfur-containing compound in the second ink receiving layer with respect to the first ink receiving layer is from 0 to 0.6.

The foregoing description of the exemplary embodiments of the present invention has been provided for the purposes of illustration and description. It is not intended to be exhaustive or to limit the invention to the precise forms disclosed. The embodiments were chosen and described in order to best explain the principles of the invention and its practical applications, thereby enabling others skilled in the art to understand the invention for various embodiments and with the various modifications as are suited to the particular use contemplated.

All publications, patent applications, and technical standards mentioned in this specification are herein incorporated by reference to the same extent as if such individual publication, patent application, or technical standard was specifically and individually indicated to be incorporated by reference. It will be obvious to those having skill in the art that many changes may be made in the above-described details of the preferred embodiments of the present invention. It is intended that the scope of the invention be defined by the following claims and their equivalents.

What is claimed is:

1. A method for inkjet recording, comprising recording an image by applying an ink by an inkjet method onto an inkjet recording medium comprising a substrate and an ink receiving layer, the ink receiving layer comprising inorganic fine particles and a water-soluble metal compound provided on the substrate, and drying at least the image recorded on the inkjet recording medium, wherein the recording medium comprises, on the substrate in this order from the substrate side:

a first ink receiving layer comprising inorganic fine particles, a nitrogen-containing organic cationic polymer and an optional water-soluble metal compound; and a second ink receiving layer comprising inorganic fine particles, a water-soluble metal compound and an optional nitrogen-containing organic cationic polymer, wherein a content of the nitrogen-containing organic cationic polymer in the first ink receiving layer is higher than that in the second ink receiving layer, and a content of the water-soluble metal compound in the first ink receiving layer is lower than that in the second ink receiving layer, wherein the drying is performed by providing heat in an amount of 2 kJ or less per 102 mm×152 mm, and wherein a maximum total ejection amount of the ink is from 10 $mL/m^2$ to 36 $mL/m^2$.

2. The method for inkjet recording according to claim 1, wherein the inorganic fine particles are selected from the group consisting of silica fine particles, alumina fine particles and pseudo boehmite.

3. The method for inkjet recording according to claim 1, wherein the water-soluble metal compound is a water-soluble aluminum compound.

4. The method for inkjet recording according to claim 1, wherein the drying is performed by dielectric heating.

5. The method for inkjet recording according to claim 1, wherein the drying is performed by infrared heating.

6. The method for inkjet recording according to claim 4, wherein the dielectric heating in the drying is performed by microwave heating.

7. The method for inkjet recording according to claim 1, wherein the drying is started within 20 seconds from the completion of the applying of the ink in the recording of the image.

8. The method for inkjet recording according to claim 1, wherein the ink is a dye-containing ink comprising a dye as a colorant.

9. The method for inkjet recording according to claim 1, wherein the content ratio of the nitrogen-containing organic cationic polymer in the second ink receiving layer with respect to the first ink receiving layer is from 0 to 0.8, and the content ratio of the water-soluble metal compound in the first ink receiving layer with respect to the second ink receiving layer is from 0 to 0.8.

10. The method for inkjet recording according to claim 1, wherein the nitrogen-containing organic cationic polymer comprises particles of a cationic polyurethane resin.

11. The method for inkjet recording according to claim 1, wherein the ink receiving layer further comprises a water-soluble resin.

12. The method for inkjet recording according to claim 1, wherein at least the first ink receiving layer further comprises a sulfur-containing compound, and a content of the sulfur-containing compound in the first ink receiving layer is higher than that in the second ink receiving layer.

13. The method for inkjet recording according to claim 12, wherein the sulfur-containing compound is a thioether compound or a sulfoxide compound.

14. The method for inkjet recording according to claim 12, wherein the content ratio of the sulfur-containing compound in the second ink receiving layer with respect to the first ink receiving layer is from 0 to 0.6.

* * * * *